US006929132B2

(12) United States Patent
Belt

(10) Patent No.: US 6,929,132 B2
(45) Date of Patent: Aug. 16, 2005

(54) DISPLAY STRIP

(76) Inventor: James G. Belt, 7964 Hidden Harbour, Holland, OH (US) 43528

( * ) Notice: Subject to any disclaimer, the term of this patent is extended or adjusted under 35 U.S.C. 154(b) by 0 days.

(21) Appl. No.: 10/640,540

(22) Filed: Aug. 12, 2003

(65) Prior Publication Data

US 2004/0099626 A1 May 27, 2004

Related U.S. Application Data

(63) Continuation-in-part of application No. 10/302,230, filed on Nov. 22, 2002, now abandoned.

(51) Int. Cl.[7] ..... A47F 7/00
(52) U.S. Cl. ..... 211/113; 211/85.15
(58) Field of Search ..... 211/113, 85.15, 211/85.29

(56) References Cited

U.S. PATENT DOCUMENTS

| | | | | |
|---|---|---|---|---|
| 2,001,798 | A | | 5/1935 | Schreiber |
| 2,361,141 | A | | 10/1944 | Woolf et al. |
| 2,606,665 | A | | 8/1952 | Caswell |
| 2,647,640 | A | | 8/1953 | Ellis |
| 3,047,144 | A | | 7/1962 | Wissel |
| 3,608,711 | A | | 9/1971 | Wiesler et al. |
| 3,954,049 | A | | 5/1976 | Brieske |
| 4,015,708 | A | | 4/1977 | Kelm |
| 4,312,449 | A | | 1/1982 | Kinderman |
| 4,378,903 | A | | 4/1983 | Sherwood |
| 4,422,552 | A | | 12/1983 | Palmer et al. |
| 4,546,943 | A | | 10/1985 | Fast |
| 4,667,827 | A | | 5/1987 | Calcerano |
| 4,767,012 | A | | 8/1988 | Simmons |
| 4,817,805 | A | | 4/1989 | Rodriquez |
| 4,823,489 | A | | 4/1989 | Cea |
| 4,911,392 | A | | 3/1990 | Fast |
| 5,199,578 | A | | 4/1993 | Pendergraph et al. |
| 5,248,036 | A | | 9/1993 | Radocha, Sr. et al. |
| 5,284,259 | A | | 2/1994 | Conway et al. |
| 5,339,967 | A | | 8/1994 | Valiulis |
| 5,386,916 | A | | 2/1995 | Valiulis |
| 5,469,959 | A | | 11/1995 | Gummer |
| 5,553,721 | A | | 9/1996 | Gebka |
| 5,598,922 | A | | 2/1997 | Good |
| 5,678,699 | A | | 10/1997 | Gebka |
| 5,683,003 | A | | 11/1997 | Gebka |
| 5,762,212 | A | | 6/1998 | Pomerantz |
| D412,721 | S | | 8/1999 | DeFelice |
| 5,957,422 | A | | 9/1999 | Shea |
| 6,109,582 | A | | 8/2000 | Repaci et al. |
| 6,405,778 | B1 | * | 6/2002 | Belt ..... 156/519 |
| 6,481,184 | B1 | * | 11/2002 | Junker et al. ..... 53/413 |
| 2004/0040919 | A1 | * | 3/2004 | Iwasaki et al. ..... 211/71.01 |
| 2004/0089622 | A1 | * | 5/2004 | Miller et al. ..... 211/113 |

* cited by examiner

*Primary Examiner*—Robert W. Gibson, Jr.
(74) *Attorney, Agent, or Firm*—John C. Purdue; David C. Purdue

(57) ABSTRACT

A display strip or merchandiser for displaying items offered for sale is disclosed. The display strip comprises a strip and a plurality of adhesive portions adhered to the strip for releasably adhering to the strip items to be held by the display strip. The adhesiveness between the adhesive portions and such items is less than the adhesiveness between the adhesive portions and the strip. The adhesive portions may comprise two-sided adhesive tape.

4 Claims, 23 Drawing Sheets

DISPLAY STRIP

BACKGROUND OF THE INVENTION

1. Field of the Invention

The present invention relates generally to display strips, articles useful for displaying a plurality of items for sale, typically positioned in retail outlets to maximize impulse purchasing. More specifically, the present invention is concerned with a pre-loaded, disposable display strip, as well as apparatus and a method for producing such display strips.

2. Description of the Prior Art

Display strips are known. Many comprise a strip of material having means for suspending the strip from the top and a plurality of hooks or fingers for supporting an apertured item offered for sale. These types of display strips are reusable. After the merchandise has been removed, new merchandise is hung from the strip. This is a time consuming task for delivery people and clerks who reload these strips. Breakage is a frequent problem with commercial, reusable display strips requiring replacement.

During a search of the Patent and Trademark Office web site bibliographic patent database, directed to the present invention, the following patents were noted: U.S. Pat. No. 3,954,049 (Brieske) entitled Method of Making Flexible Bag; U.S. Pat. No. 4,378,903 (Sherwood) entitled Hanging Tab With Single Line of Adhesive and Hanging Hole Clear of Adhesive; U.S. Pat. No. 4,546,943 (Fast) entitled Strip Merchandiser; U.S. Pat. No. 4,767,012 (Simmons) entitled Strip Hanger; U.S. Pat. No. 4,817,805 (Rodriquez) entitled Apparatus for Securing, Displaying and Dispensing of Envelope Package Goods; U.S. Pat. No. 4,823,489 (Cea) entitled Method of Making a Three Dimensional Composite Display Card; U.S. Pat. No. 4,911,392 (Fast) entitled Strip Merchandiser with Reinforcement Section; U.S. Pat. No. 5,199,578 (Pendergraph et al.) entitled Clip Strip for Supporting Multiple Packages and Display Assembly Using Same; U.S. Pat. No. 5,248,036 (Radocha, Sr., et al.) entitled Strip Type Point-of-Sale Display Unit; U.S. Pat. No. 5,284,259 (Conway, et al.) entitled Two Sided Merchandising Strip; U.S. Pat. No. 5,339,967 (Valiulis) entitled Strip Merchandiser; U.S. Pat. No. 5,386,916 (Valiulis) entitled Adjustable Strip Merchandiser; U.S. Pat. No. 5,469,959 (Gummer) entitled Hosiery Display Package; U.S. Pat. No. 5,553,721 (Gebka) entitled Reversible Strip Merchandiser; U.S. Pat. No. 5,598,922 (Good) entitled Product Display Hanger; U.S. Pat. No. 5,678,699 (Gebka) entitled Strip Merchandiser Hanger and Label Holder; U.S. Pat. No. 5,683,003 (Gebka) entitled Strip Merchandiser Hanger and Label Holder; U.S. Pat. No. 5,762,212 (Pomerantz) entitled Display Strip Merchandiser; U.S. Pat. No. D412,721 (DeFelice) entitled Merchandising Strip; U.S. Pat. No. 6,109,582 (Repaci et al.) entitled Product Shipping and Display Strip System; U.S. Pat. No. 2,361,141 (Woolf et al.) entitled Show Card; U.S. Pat. No. 2,606,665 (Caswell) entitled Display and Dispensing Device; U.S. Pat. No. 2,647,640 (Ellis) entitled Display Card; U.S. Pat. No. 4,312,449 (Kinderman) entitled Apparatus for the Display of Goods; U.S. Pat. No. 4,422,552 (Palmer et al.) entitled Card for Mounting Bags and the Like; U.S. Pat. No. 4,667,827 (Calcerano) entitled Package Carrier; U.S. Pat. No. 4,015,708 (Kelm) entitled Button Cell Storage and Merchandising Package; U.S. Pat. No. 3,047,144 (Wissel) entitled Ad-Token Card; U.S. Pat. No. 3,608,711 (Wiesler et al.) entitled Package for Electronic Devices and the Like; U.S. Pat. No. 2,001,798 (Schreiber) entitled Display Device; and U.S. Pat. No. 5,957,422 (Shea) entitled Reinforced Strip Display Assembly Capable of Supporting High Volumes of Smaller Impulse Merchandise.

The Rodriquez Patent discloses apparatus for securing, displaying and dispensing envelope package goods. The apparatus comprises a securing strip, a masking strip and adhesive between the two strips. Adhesive for securing a package to the apparatus is applied to the securing strip and is presented through apertures in the masking strip so that packages may be pressed against the exposed adhesive, thereby releasably securing the package to the apparatus. Thus, the Rodriquez apparatus comprises two strips and packages are secured directly to adhesive, which, in turn, is secured directly to the securing strip. This requires fairly precise alignment between packages and apertures in the masking strip for securing packages to the strip.

SUMMARY OF THE INVENTION

The present invention is based upon discoveries of a display strip, of a pre-loaded, disposable display strip, of apparatus for producing the display strip, of methods for producing the display strip, and of methods for displaying items to be sold. The display strip comprises a strip, a hanger at one end of the strip for suspending the strip from something, and a plurality of adhesive items to be offered for sale, adhesively connected or sealed to the strip in staggered locations on the strip. In a first embodiment, apparatus for producing the display strip comprises a strip material feeder operable to deliver or feed strip material to a station to which items to be sold are also delivered, a tape arm operable to advance tape, a tape cutter operable to cut off a piece of the tape, and an install pad operable to apply the piece of tape to a portion of the strip and to a portion of an item to be sold or to packaging for the item. In a method for producing the display strip with apparatus of the first embodiment, the items to be sold are delivered to the station of the apparatus and so is the strip material until a portion of the next item is adjacent to a portion of the strip material. Tape is advanced through the tape arm, and the tape cutter and the install pad are advanced to cut off a piece of the tape and to engage the piece of tape. The install pad is advanced to apply the piece of tape to a portion of the strip material and to a portion of the item or the packaging for the item. The strip material with the item secured thereto is advanced and a fresh portion of the strip material is delivered to the station. A new item is delivered to the station as well, and the previously recited steps are repeated so that a new piece of tape is applied to the fresh portion of the strip material and to a portion of the next item or packaging for the item. Additional items are secured to successive portions of the strip material until a desired number of items are supported on the strip. The strip material is cut to release a loaded display strip from the strip material. Preferably, an aperture is punched or another hanger is formed in the strip at the end from which it is desired to hang the strip. In the former case, the portion of the strip adjacent to the aperture constitutes a hanger, which can support the display strip on a hook or the like. Other hangers may certainly be employed.

In a second embodiment of apparatus for producing a display strip, the tape arm, the tape cutter and the tape install pad are replaced with a heat element which heat seals a portion of an item or packaging for an item to a portion of the strip material which, preferably, is a heat seal tape or tabbing tape. In a method for producing the display strip with apparatus of the second embodiment, the items to be sold are delivered to the station of the apparatus and so is the strip material until a portion of the next item or packaging for the item is adjacent to a portion of the strip material. A heat element is advanced to heat the portion of the next item or packaging for the item, the adjacent portion of the strip material, or both, until the portion of the item or packaging for the item is adhered or secured to the portion of the strip material. The strip material with the item secured thereto is advanced and a fresh portion of the strip material is delivered to the station. A new item is delivered to the station as well, and the previously recited steps are repeated so that a portion of the new item or packaging for the item is secured to the fresh portion of the strip material. Additional items are secured to successive portions of the strip material until a desired number of items are supported on the strip. The strip material is, again, cut to release a loaded display strip from the strip material.

A third, preferred embodiment of apparatus for producing a display strip comprises a first station for straightening the edges of packages and engaging the straightened edges in transfer holding fingers, a conveyer for transferring the packages to a second station at which ends of the packages are adhesively secured to display strip material, and a third station for producing display strip material comprising a strip of material with a plurality of apertures and a strip of adhesive tape secured to a first side of the first strip, with the adhesive side of the tape exposed through the apertures. Display strip material produced at the third station is delivered to the second station, where the ends of packages are forced into intimate contact with the successive exposed portions of adhesive tape, thereby securing the packages to the display strip material.

A fourth embodiment of apparatus according to the invention comprises a first station for producing display strip material comprising a strip of material with discreet portions of two-sided adhesive tape at spaced intervals along the length of the strip, on one side thereof. Alternatively, the display strip material may comprise a strip of material with a continuous strip of two-sided adhesive material on one side of the strip of material with or without discreet pieces of material covering discreet portions of the adhesive tape. This apparatus may include an end straightening station for straightening the end of a package, and a conveyor for conveying packages with straightened ends to the first station for adhesive attachment to the display strip material.

A display strip according to the present invention is disposable and comprises a minimal amount of material. A person charged with stocking items loaded on a display strip according to the present invention can stock a plurality of the items by hanging a single display strip.

In the cases where the items to be secured to a strip to produce a display strip constitute snack foods packaged in bags by means of vertical form, fill and seal equipment, it may be desired to secure a portion of the sealed end of each bag to successive portions of the strip material. In that case, difficulty may be encountered because the sealed ends of one or more bags may be substantially non-planar so that the end of the bag doesn't lay flat against the portion of the strip material. This situation is addressed by apparatus, according to the instant invention, comprising a straightener for straightening the edge of a bag or the like, and a gripper for engaging the end of the bag so that the edge remains substantially straight. The straightener preferably comprises a pair of brush rollers that rotate in opposite directions. Preferably, the brush rollers are mounted on swing arms so that they can be pivoted from a first position in which the rollers are adjacent to each other and are operable to straighten the edge of the bag, to a second position in which they are positioned away from the edge of the bag. Preferably, a stop is provided so that, when the swing arms are in the first position and a bag edge passes between the brush rollers, the bag edge is advanced by the action of the brush rollers until it engages the stop. At that instant, a gripper engages the end of the bag, the swing arms are moved to the second position, and the gripped bag is advanced to position a portion of the edge adjacent to a target portion of the strip material for securement thereto by means of adhesive or tape or heat sealing.

Accordingly, it is an object of the present invention to provide a pre-loaded display strip, which makes restocking an item as simple as hanging the display strip somewhere.

It is a further object of the present invention to provide an apparatus for producing the display strip, which is pre-loaded with items to be sold.

It is yet another object of the present invention to provide a method for producing a pre-loaded display strip.

These and other objects and advantages of the present invention will no doubt become apparent to those skilled in the art after having read this detailed description of the invention including the following description of the preferred embodiments, which are illustrated by the various figures of the drawing.

DETAILED DESCRIPTION OF THE PREFERRED EMBODIMENTS

Figure 1:
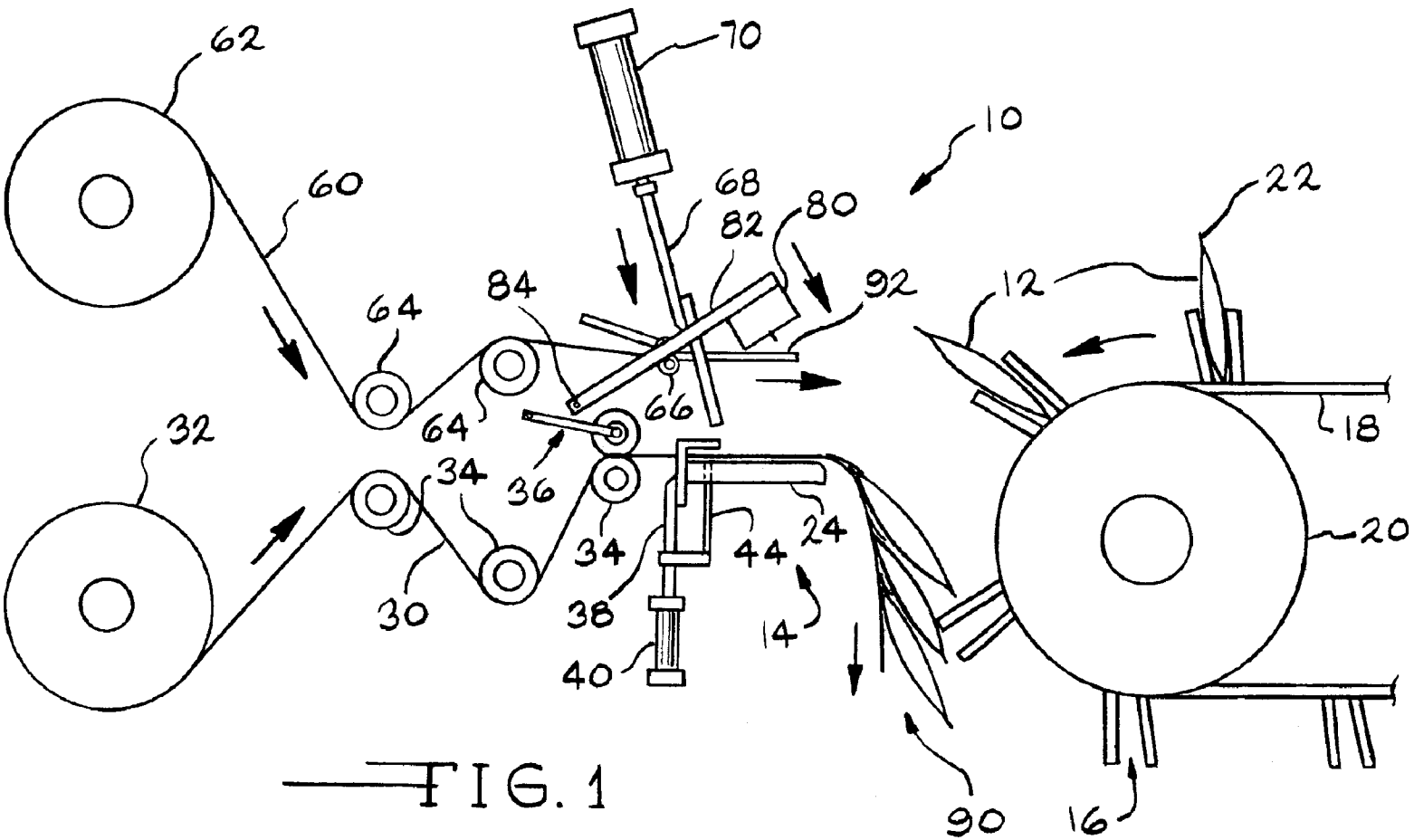
FIG. 1 is a side view of apparatus according to the present invention for producing pre-loaded display strip, as strip material and tape are advanced to a station.

Referring to FIGS. 1 through 4, apparatus according to the present invention for producing a pre-loaded display strip is indicated generally at 10. Items 12 are advanced towards a station, indicated generally at 14. The items 12 can be one of thousands of products from pork rinds to tape, to aspirin, to antacids, and beyond. In FIGS. 1 through 4, the items 12 are illustrated as being snack bags each having flattened sealed ends 22.

The items 12, in the illustrated embodiment, are carried in pockets 16, which support the items 12 on a conveyor 18, which turns around a roller 20. It will be appreciated that certain economies of manufacture can be realized if items 12 are supplied to the apparatus 10 as they are produced, i.e., in-line with the manufacturing and/or packaging of a product constituting the items 12. In any case, the items 12 are advanced, right to left in FIGS. 1 through 4, towards the station 14, until an end 22 of a next item N (FIG. 1) is supported on a base 24.

Strip material 30 is supplied from a roll 32 and passes over rollers 34 and is delivered to the station 14 where a portion of it is supported on the base 24. An advancer, indicated generally at 36, is operable, in a first mode, and inoperable, in a second mode, to advance a new portion of the strip material 30 into the station. It will be appreciated that the advancer may further comprise a counter or sensor (not shown) to provide information about the position of the strip material 30 in the apparatus 10. The strip material may comprise a polymeric material. A preferred strip material is a thin polyester film and it can have a thickness of 7 thousandths of an inch. A suitable width is one and one half inches. These dimensions can be varied widely, within the scope of the present invention, depending on the requirements of a particular application.

Figure 4:
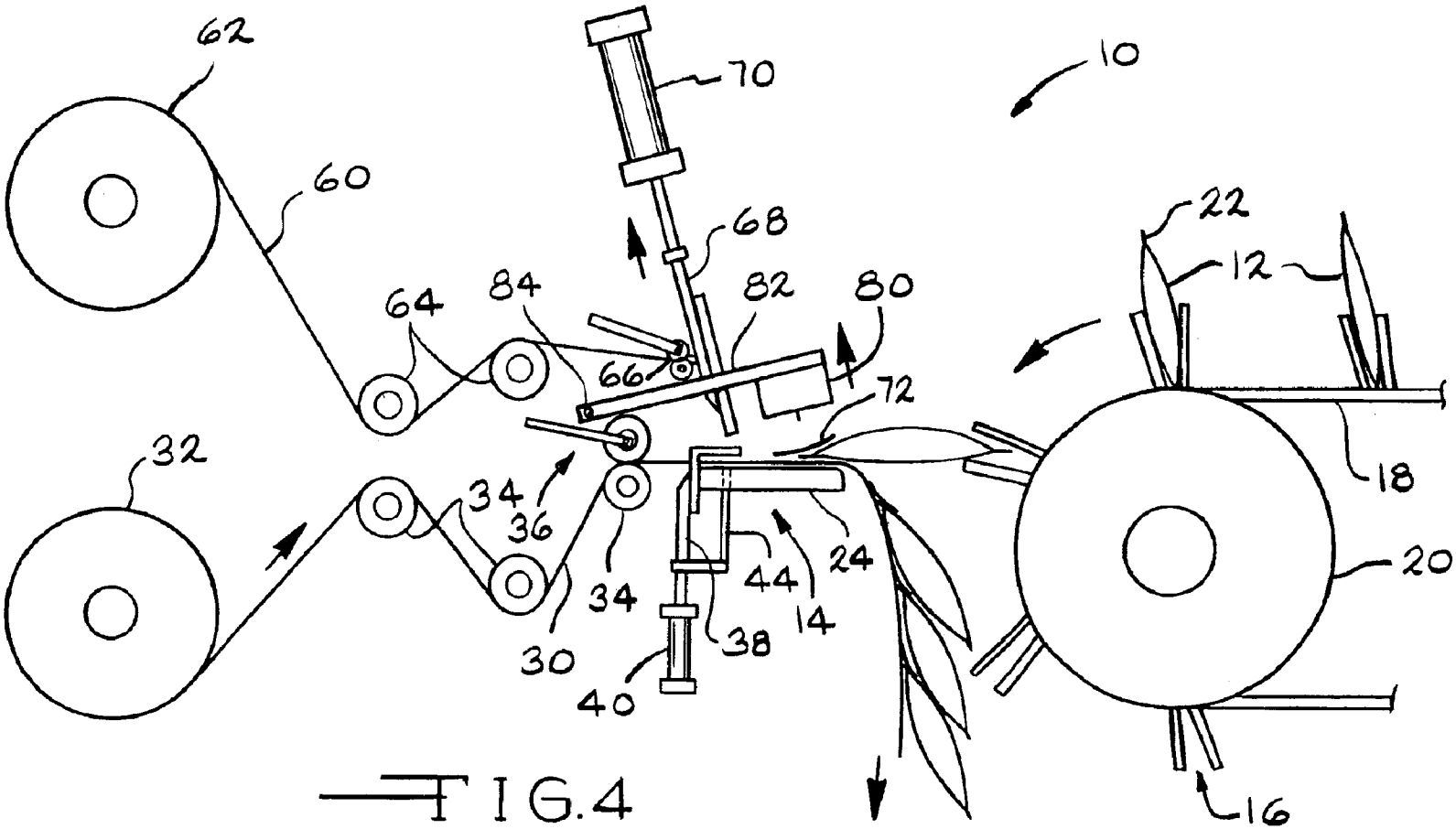
FIG. 4 is a side view of the apparatus shown in FIGS. 1 through 3 as a new item is delivered to the station, strip material is advanced and the install pad is withdrawn along with the tape cutter.
Figure 5:
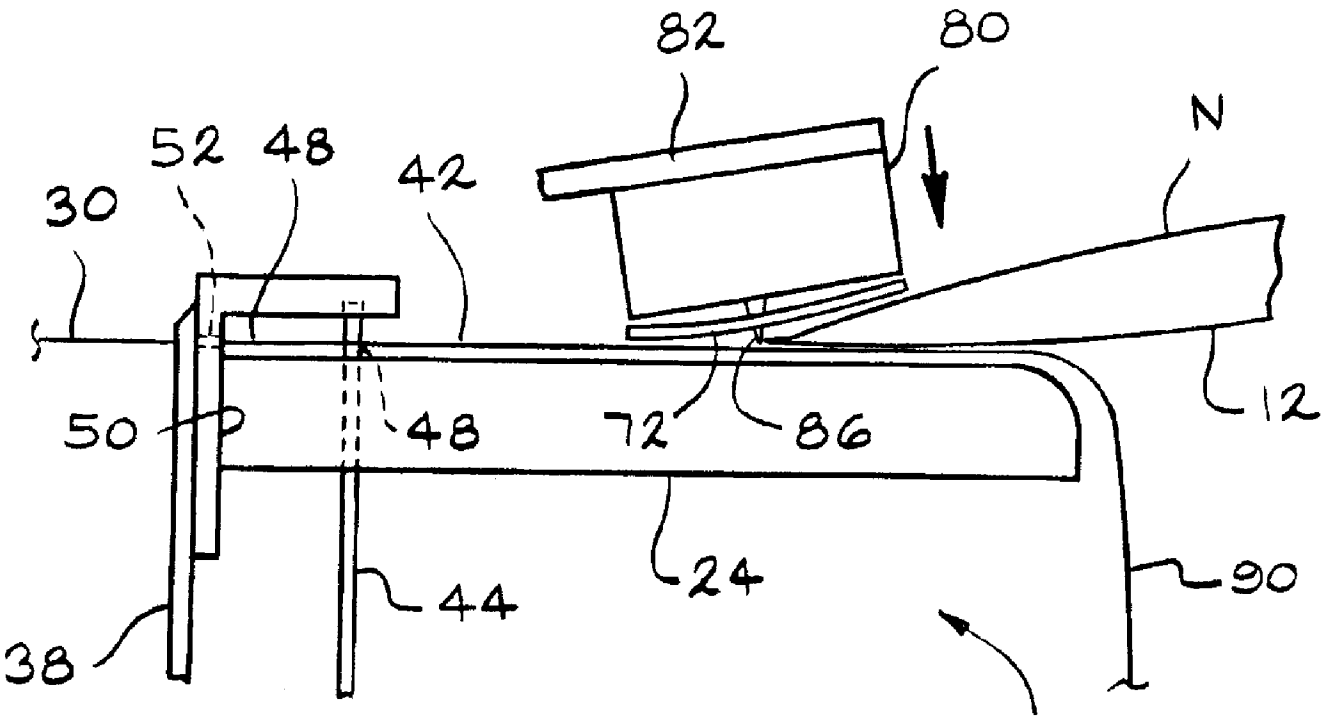
FIG. 5 is a detail view of a portion of the apparatus shown in FIGS. 1 through 4, as the install pad applies a piece of tape to portions of the strip material and to the item, and a pre-loaded display strip is severed from the strip material.
Figure 6:
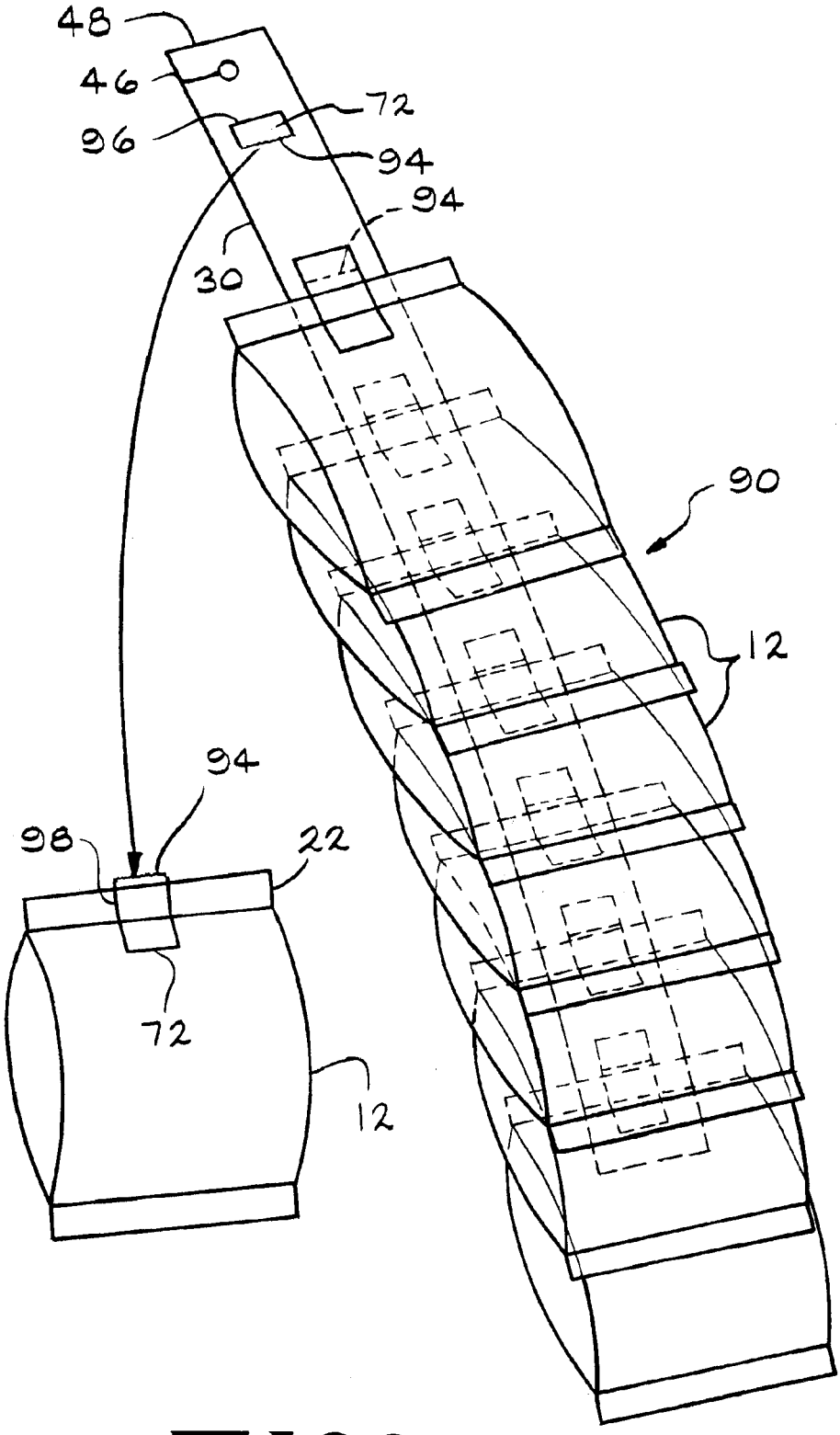
FIG. 6 is a perspective view of a display strip according to the present in invention.

The apparatus 10 further comprises a strip material cutter 38 for cutting strip material 30. The cutter 38 is supported on an actuator 40 for reciprocating movement between a first, retracted position (FIGS. 1 through 4) and a second, extended position (FIG. 5). Referring to FIG. 5, in traveling from the first position to the second position, the cutter 38 is operable to cut through the strip material 30, severing a strip 42 from the strip 15 material 30. A punch 44 is supported on the actuator 40 (FIGS. 1 through 4) for reciprocating movement with the cutter 38 between a first, retracted position (FIGS. 1 through 4) and a second, extended position (FIG. 5). In moving from the first to the second position, the punch 44 is operable to form a hole 46 (FIGS. 5 and 6) in the strip 42, near a first end 48 thereof. An anvil 50, including a strip guide 52, is supported on the base 24 and cooperates with the cutter 38 and the punch 44 in a known fashion.

Tape 60 is supplied from a roll 62, passes over rollers 64 and is delivered to the station 14. The tape also passes through a tape advancer comprises cooperating V-drive serrated pulleys 66 which advance the tape 60, as needed, into the station 14. Counters and/or sensors (not shown) may be associated with the tape delivery system to provide information about the position of the tape 60 in the apparatus 10. A suitable, single sided adhesive tape is one available from 3M under the designation 375. It is about one inch wide. Many adhesive tapes are suitable for use in producing display strip according to the present invention.

Figure 2:
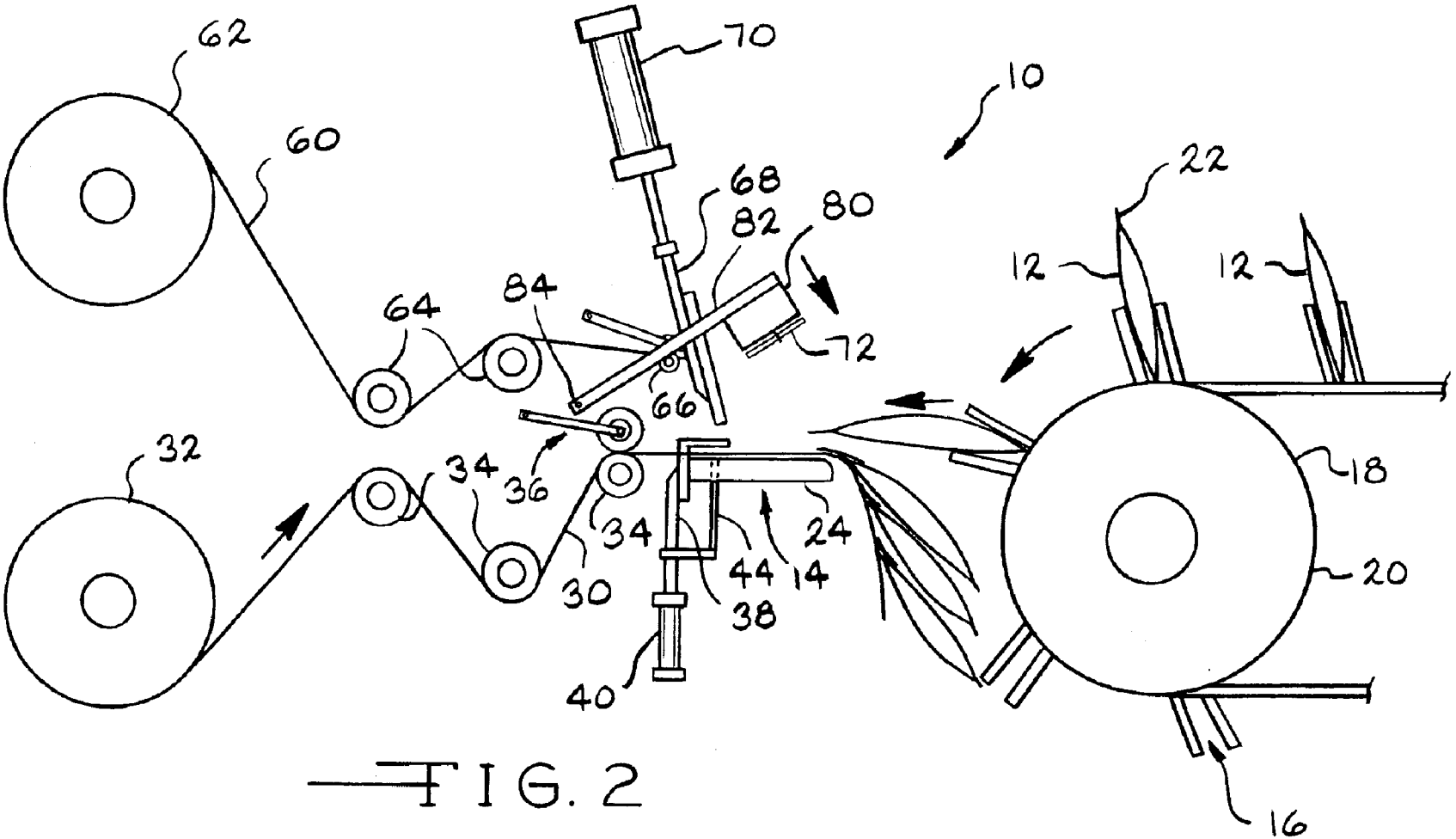
FIG. 2 is a side view of the apparatus shown in FIG. 1 as a piece of tape is cut from a tape and held on an install pad.
Figure 3:
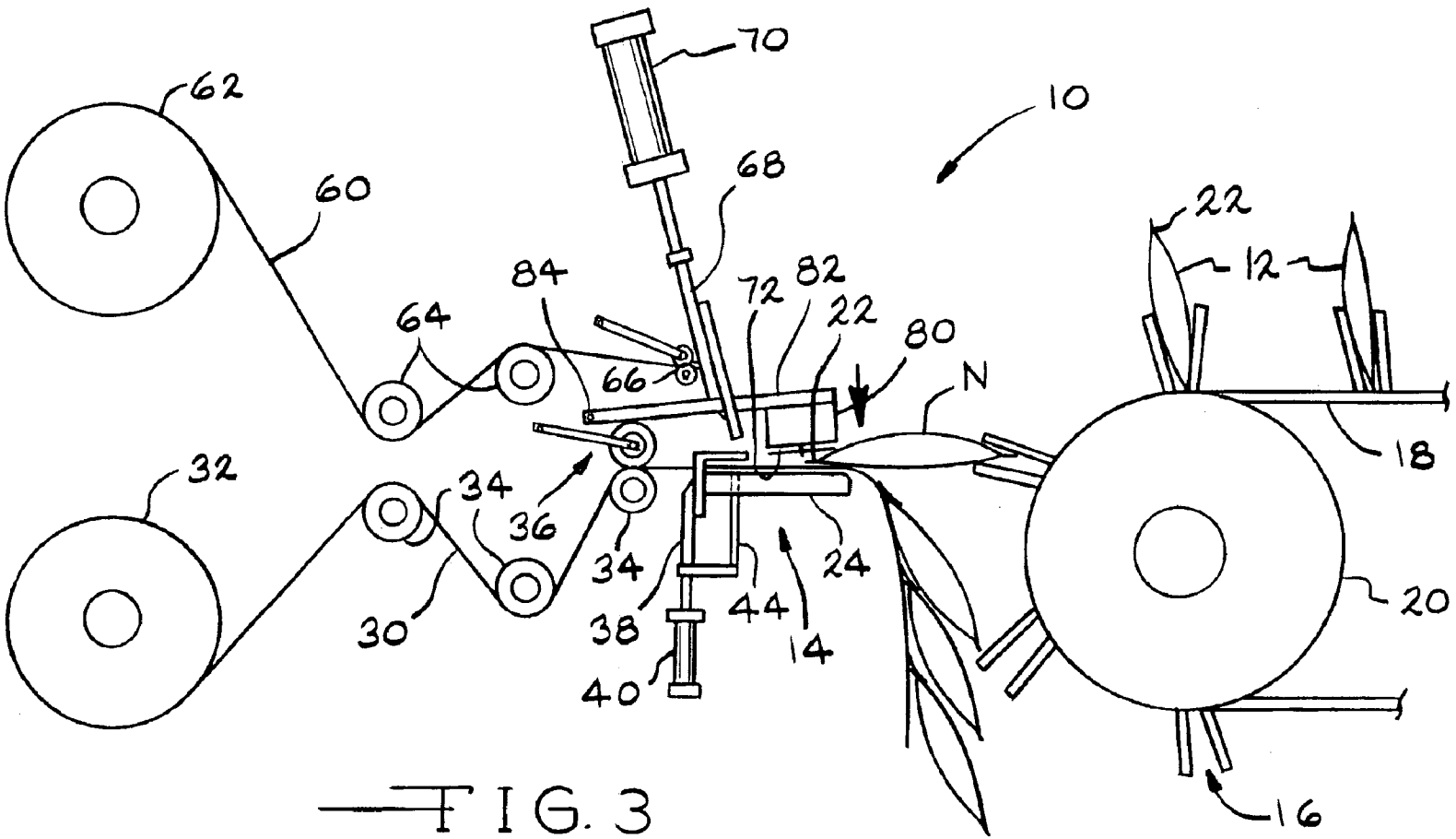
FIG. 3 is a side view of the apparatus shown in FIGS. 1 and 2 as the piece of tape is applied to a portion of the strip material and to a portion of an item.

The apparatus 10 further comprises a tape cutter 68 for cutting tape 60. The cutter 68 is supported on an actuator 70 for reciprocating movement between a first, retracted position (FIG. 1) and a second, extended position (FIGS. 2 through 4). In traveling from the first position to the second position, the tape cutter 68 is operable to cut through the tape 60, severing a piece of tape 72 from the tape 60.

A tape install pad 80 is supported on an arm 82 which is supported for pivotal movement about a pivot support 84 between a first, retracted position (FIGS. 1 and 2) and a second, extended position (FIG. 3). In moving from the first to the second position, the install pad 80 is operable to engage and hold the piece of tape 72 after it is severed from the tape 60. The install pad 80 can be provided with a vacuum tape retainer system (not shown) or other means for holding a piece of tape momentarily. The install pad should be made of a relatively resilient material so that a fairly uniform pressure is applied to the tape piece 72. A perf cutter 86 (best seen in FIG. 5) is supported on the install pad 80, if desired, for reasons discussed below.

The operation of the apparatus 10 to produce a display strip 90 (FIG. 6) will now be described. In FIG. 1, there is a portion of a display strip 90 hanging down from the right side of the base 24. First, the steps involved in adding a next item 12 to the partial display strip 90 will be set forth.

After an item 12 has been taped to the strip material 30, the install pad arm 82 pivots to the first, retracted position shown in FIG. 1. The tape 60 is advanced, left to right, by and between the V-drive serrated pulleys. An end portion 92 of the tape extends to the right of the V-drive pulleys 66. Although the end 92 is suspended in air, it has a V-shape in cross section and is self-supporting. The strip material 30 is also advanced, left to right, until the last item taped to the strip material is removed from the station 14, as shown in FIG. 1. A next item 12 is advancing, in a pocket 16, right to left, towards the station 14.

In FIG. 2, the apparatus is illustrated after the next item 12 has advanced into the station and after the tape cutter 68 has severed a piece of tape 72 from the tape 60. The piece of tape 72 has been engaged by and is now held by the install pad 80. From this state, the next item 12 is positioned on the strip material 30, as shown in FIG. 3 and the install pad arm 82 is advanced toward the second position until it applies the piece of tape to a portion of the strip material 30 and to a portion of the item 12. In this case, the piece of tape 72 is applied to the end 22 of the item 12. It is noted that in FIG. 3, where this state is illustrated, the tape piece 72, the strip material 30 and the end 22 of the item 12 have been spaced for clarity.

A next item can now be added to the strip material 30 or, if the previous item 12 was to be the last item, a pre-loaded display strip can be severed from the strip material 30. A next item 12 is added by returning the apparatus 10 to the FIG. 1 position. In FIG. 4, the apparatus 10 is illustrated in an intermediate state as the install pad arm 82 is returning to its retracted position. The previously attached item 12 is about to fall out of its pocket 16 and the strip material 30 is being advanced, left to right, to move the previously attached item 12 out of the station 14. As these actions continue, tape 60 is advanced, left to right, until a new end 92 is extended, and the FIG. 1 state is reached again. The preceding sequence can then be repeated until a desired number of items 12 have been taped to the strip material 30.

After the last item 12 for a given display strip has been attached to the strip material 30, the actuator 40 and the cutter 38 are advanced to the second position and, en route, the cutter 38 severs the strip material, creating a display strip 90. The punch 44 pierces the strip material 30, on the display strip side of the cut, producing a hole, indicted at 46 in FIG. 6 near the end 48 of the display strip 90, which serves as a hanger for the display strip 90.

It will be appreciated that the control of the operation of the elements of the apparatus 10 may be carried out with known controllers, and it is specifically contemplated that micro-processors (not shown) may be utilized to control and regulate the operation of the apparatus 10. Such controllers are well known to those skilled in the art, as are the application of such controllers to control the apparatus 10 operations in the manner described above. Accordingly, such controllers will not be further described herein.

Returning now to FIG. 5, the perf cutter 86 will now be further described. The perf cutter 86 extends out of the face of the install pad 80 so that, when the install pad arm reaches the second, extended position, the perf cutter 86 perforates the tape piece 72, adjacent to the end 22 of the item 12, producing perforations. The perforations formed in the tape piece 72 serve to facilitate the removal of an item 12 from the display strip 90, as shown clearly in FIG. 6, where downward force applied to an item has cause the tape piece 72 to split into a first, strip portion 96, which remains on the display strip and a second, item portion 98, which remains on the item after it is removed from the display strip. For a given tape, a perf cutter can be selected that will perforate the tape piece 72 to the extent that the tape piece 72 is operable to hold items 12 fast to the strip 30 until a consumer exerts a comfortable, firm downward force on the item 12, causing the tape piece 72 to split and the item to be removed from the display strip 90 for sale. With the 3M tape referred to above, good results have been achieved with a perf cutter for producing dotted perforations which are a few thousandths of an inch in diameter and about sixty thousandths of an inch apart.

Figure 7:
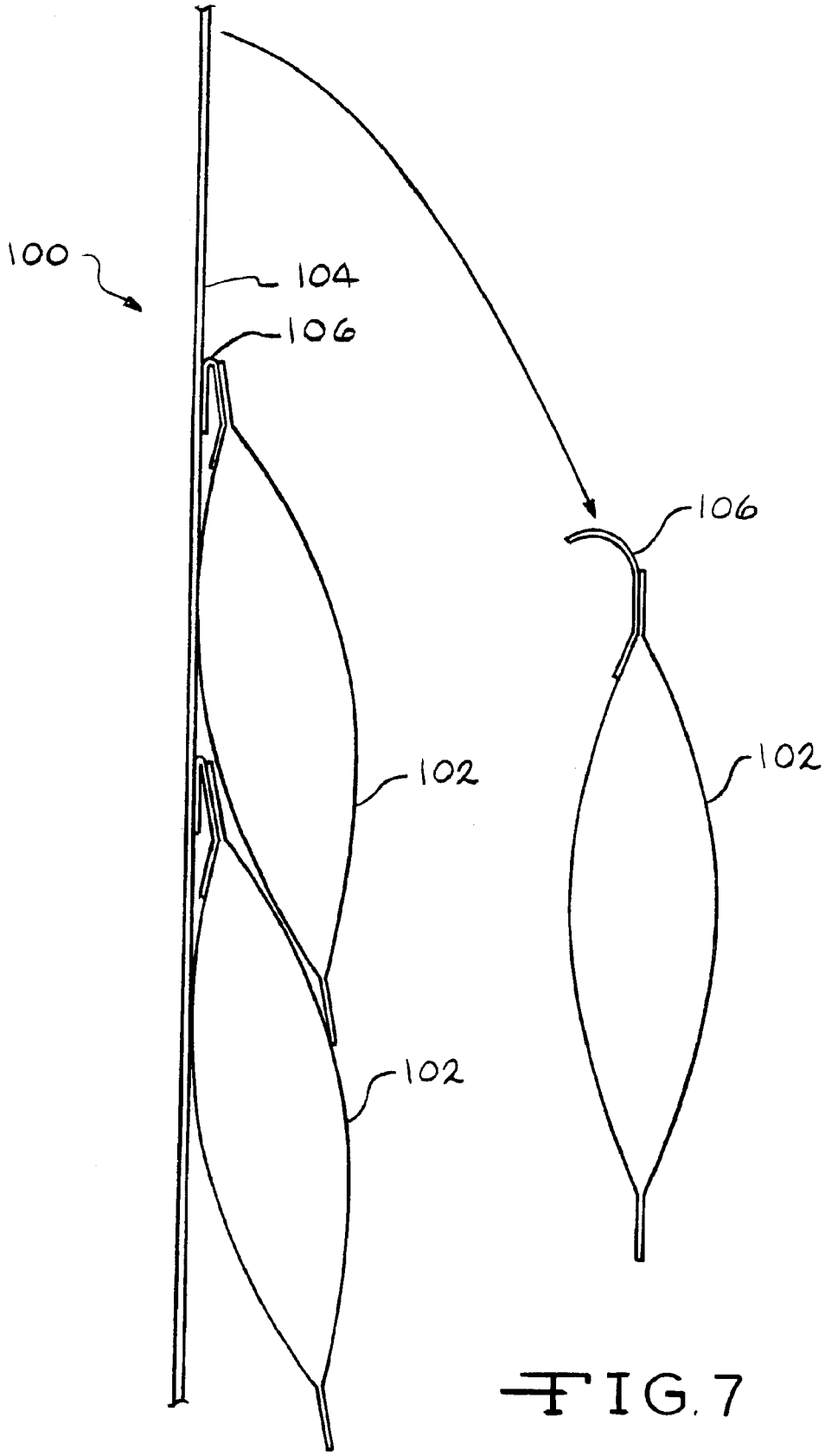
FIG. 7 is a side view of a second embodiment of a display strip according to the present invention.

Another embodiment of a display strip according to the present invention is indicated at 100 in FIG. 7. Items 102 are secured to a strip material 104 by tape pieces 106. The display strip 100 can be produced on apparatus corresponding with apparatus 10, if it is modified so that the positions of the cutter 38 and the punch 44 are reversed, whereby a hanger would be formed in what would be the upper end (not shown) of the display strip 100 as illustrated in FIG. 7. It can be seen in FIG. 7 that the tape pieces 106 are folded over on themselves. These pieces 106 may be perforated or not, as desired.

Figure 8:
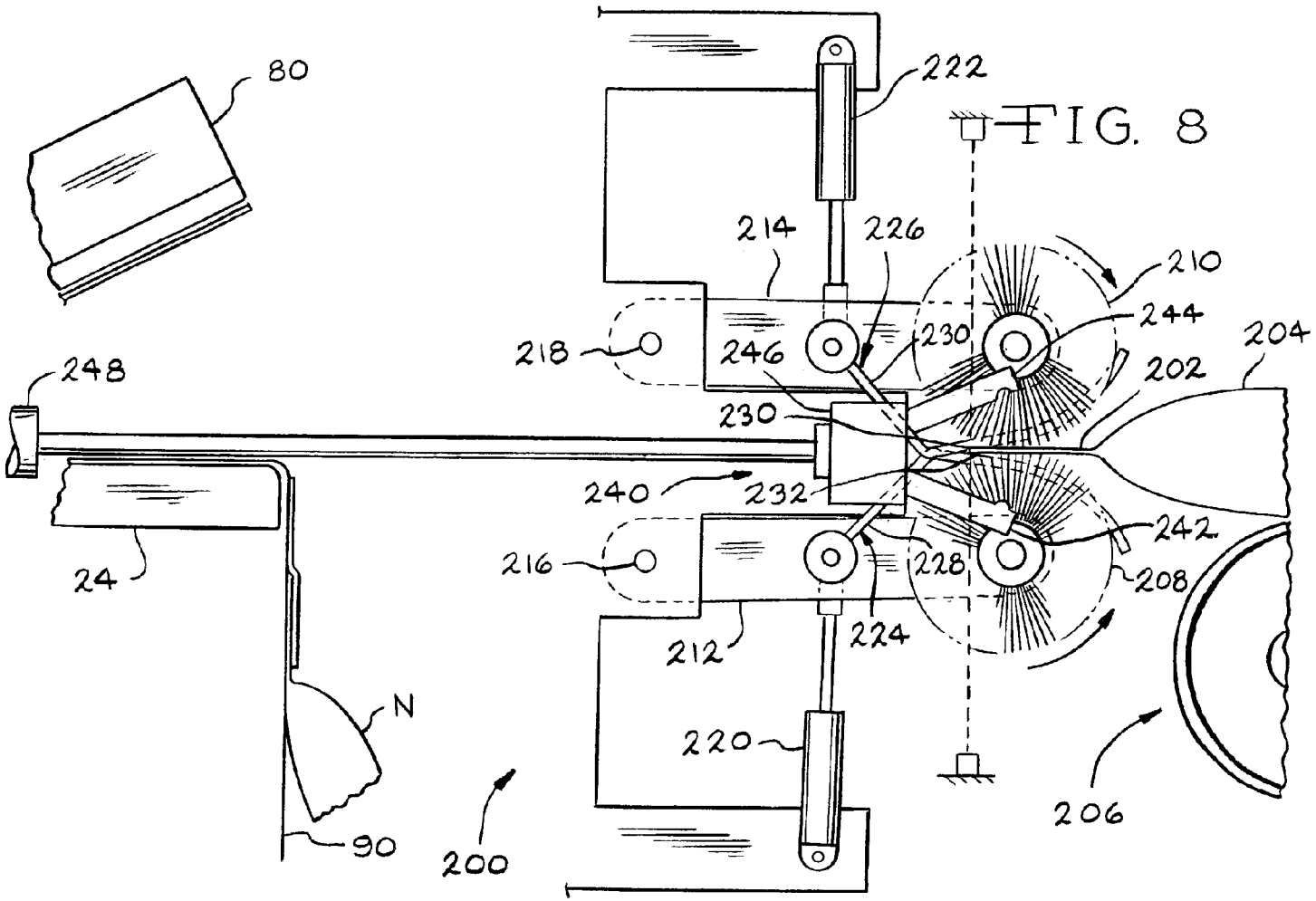
FIG. 8 is a side view of edge straightening apparatus according to the present invention as a bag is delivered thereto.

Referring now to FIG. 8, apparatus for straightening the lip or end of an item or of packaging for an item, is indicated generally at 200. The apparatus 200 is especially suited for straightening a sealed end 202 of a bag 204 which might contain a snack item. Such bags are typically formed, i.e., sealed at one end, filled with a product, and sealed, at the opposite end, in conventional equipment (not shown). Such bags 204, as they leave a form, fill and seal station, are not always of a uniform shape or configuration. Some bags will have leading ends 202 which are substantially planar and substantially parallel to a conveyor on which they are conveyed. Other bags 204 will have leading, and trailing, ends which are not substantially planar and/or which are cocked or skewed relative to a conveyor. In the latter case, the conveyor 18 with the pockets 16 (FIGS. 1 through 4) is not suitable for such bags because it is not capable of consistently positioning a desired portion of the edge of a bag on a target portion of a strip of material.

The edge straightening apparatus 200 is designed to receive snack bags 204 or the like from a conveyor 206. The apparatus 200 comprises a first, lower roller brush 208 and a second, upper roller brush 210 which are mounted on a lower arm 212 and an upper arm 214, respectively. The lower arm 212 is mounted for pivoting movement about a pivot 216 between a first, closed or stop position, shown in FIG. 8, to a second, open position shown in FIG. 10. Similarly, the upper arm 214 is mounted for pivoting movement about a pivot 218 between a first, closed or stop position, shown in FIG. 8, to a second, open position shown in FIG. 10. Movement of the lower arm 212 between the first and second positions is effected by a linear actuator 220 and a linear actuator 222 effects movement of the upper arm 214 between the first and second position. The roller brushes 208 and 210 are mounted on the arms 212 and 214 for rotation, in opposite directions, as indicated by arrows in FIG. 8. This effects a straightening of an end 202 of the bag 204 as it advances between the rollers 208 and 210. Individual bristles on the brush rollers 208 and 210 engage the sealed end 202 of the bag 204 and, as the rollers 208 and 210 rotate, the sealed end 202 of the bag 204 is pulled from left to right in FIG. 8.

An edge stop is provided by a pair of opposed sets of fingers, which mesh together in a first position to catch or stop an edge. A first, lower set of fingers 224 is supported on the lower arm 212, adjacent to the pivot point 216, for movement therewith. A second, upper set of fingers 226 is supported on the upper arm 214, adjacent to the pivot point 218, for movement therewith. Working with a bag that is about five inches wide, good results have been achieved with a lower set of fingers 224 comprising four fingers, one of which is indicated at 228, each having generally the shape shown in FIG. 8. The fingers 228 are spaced from each other about three fourths of an inch. Preferably, the upper set of fingers 226 comprises four fingers, one of which is indicated at 230. Good results have been achieved on a bag that is about five inches wide, with an upper set of fingers comprising four fingers spaced apart about three fourths of an inch. The fingers of the upper and lower sets 226 and 224 are offset from each other so that a finger from the upper set 226 is between two fingers from the lower set 224, when looking down on the apparatus 200.

When the upper and lower sets of fingers 226 and 224 are in a first, closed position, as shown in FIG. 8, they intersect a line 230 which extends between the brush rollers 208 and 210. Accordingly, when rotation of the brushes 208 and 210 pulls the bag 204 from right to left, movement of the bag 204 is stopped when an edge 232 of the end 202 of the bag advances to the position shown in FIG. 8, i.e., the edge 228 is aligned with the line 230 at the intersection of the upper and lower sets of fingers 224 and 226.

Figure 9:
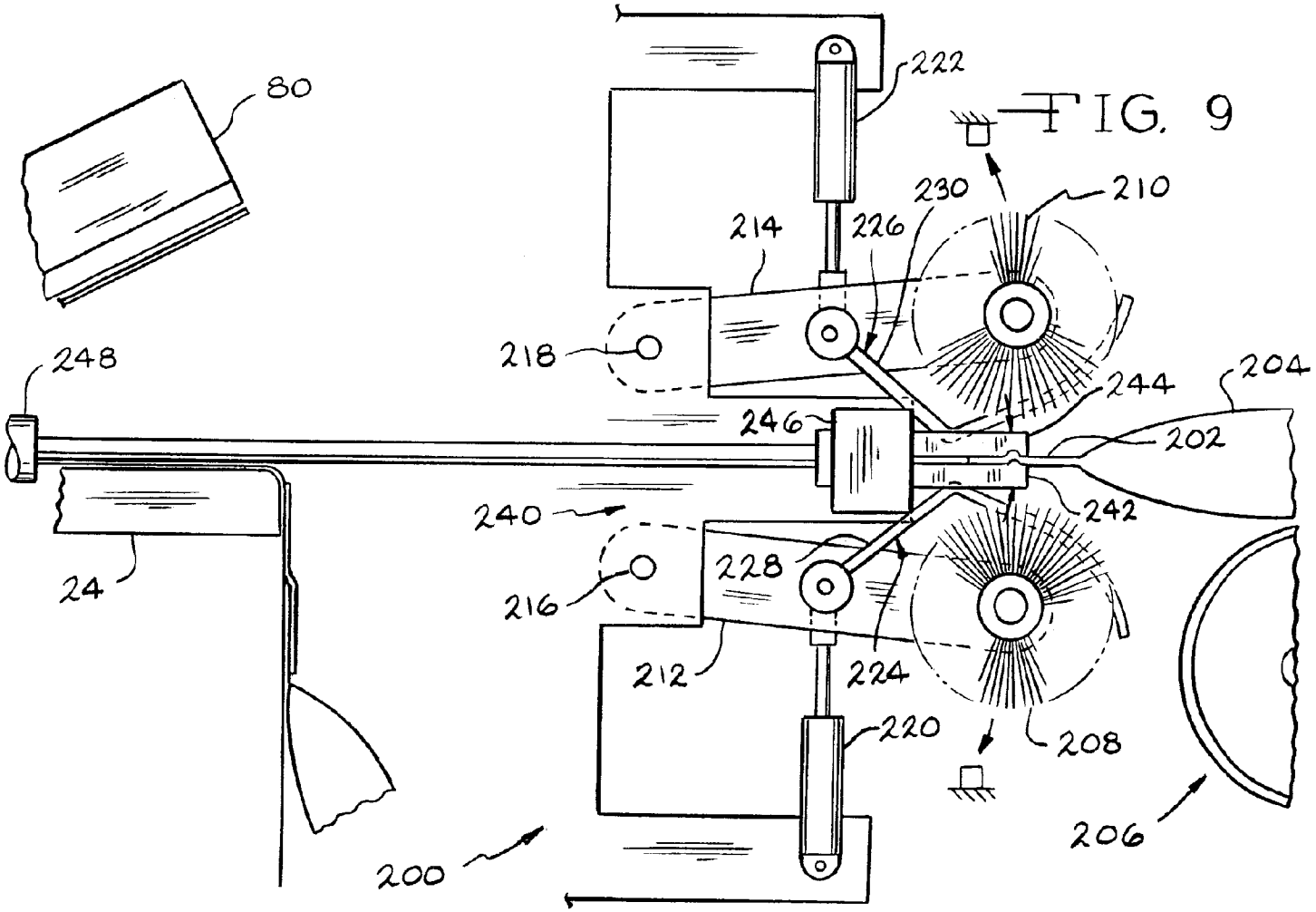
FIG. 9 is a side view of edge straightening apparatus according to the present invention as a gripper engages a straightened bag edge.
Figure 10:
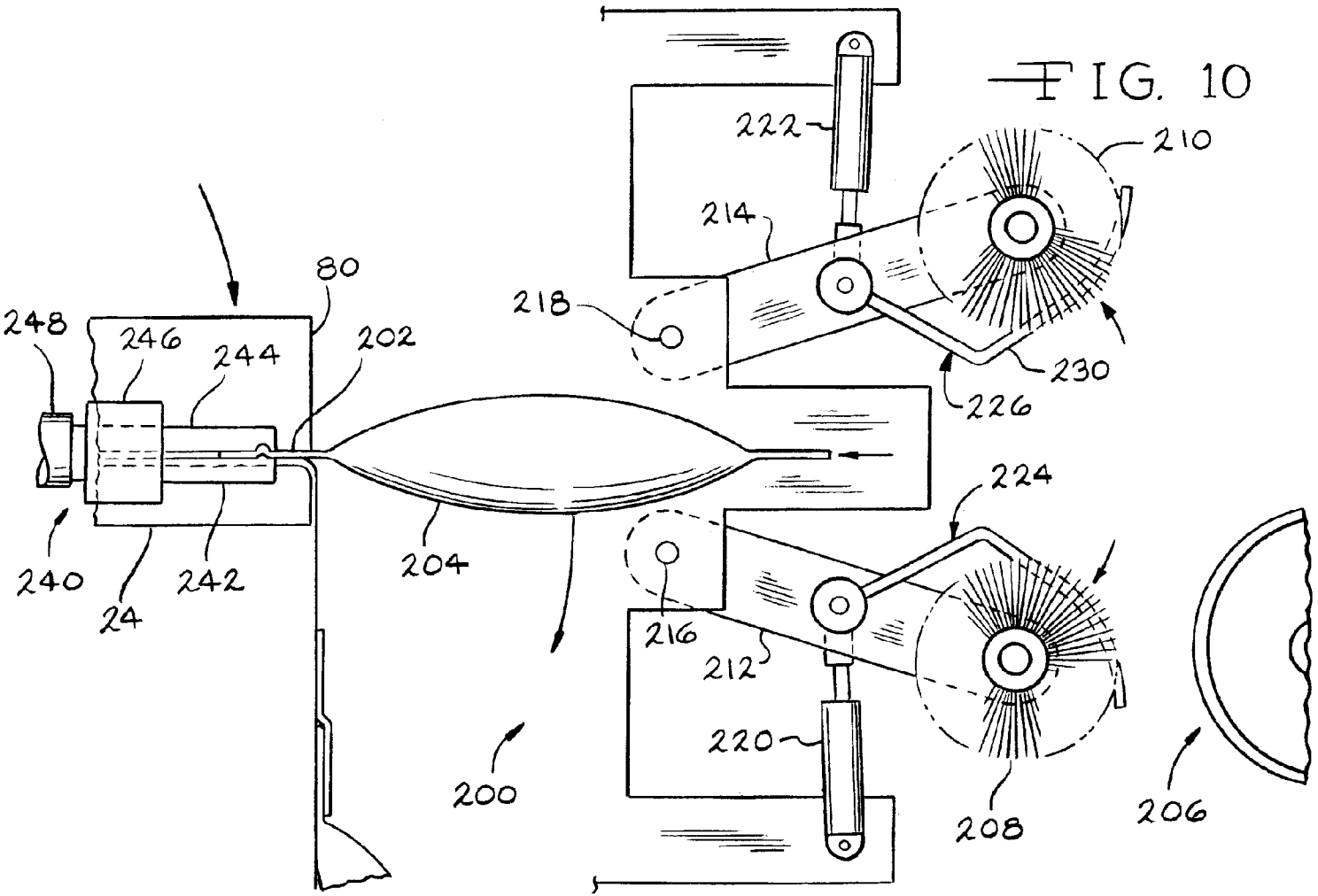
FIG. 10 is a side view of edge straightening apparatus according to the present invention after the gripper has positioned a portion of the straightened edge adjacent to a target portion of the strip material.

An end gripper indicated at 240 comprises a lower jaw 242 and an upper jaw 244, a jaw actuator 246 and a linear actuator 248. The jaw actuator 246 is operable to position the jaws 242 and 244 in a first, open position as shown in FIG. 8 and in a second, closed position as shown in FIGS. 9 and 10. Preferably, the lower jaw 242 and the upper jaw 244 each comprises a pair of spaced apart jaws so that, together, they are operable to grip two portions of the sealed end 202 of a bag 204 or the like, after it has been straightened by the action of the roller brushes 208 and 210. On a five-inch wide bag, good results have been achieved with a separation of about four inches for the upper, spaced apart jaws and a separation of about four inches for the lower, spaced apart jaws. Further, the upper and lower jaws 244 and 242 are positioned so that they can extend between the lower and upper fingers 228 and 230, as shown in FIGS. 8 and 9. The linear actuator 248 is operable to move the jaw actuator 246 from a first, extended position as shown in FIGS. 8 and 9 and a second, retracted position as shown in FIG. 10.

The operation of the apparatus 200 to deliver an end of something, which is to be attached to strip material, will now be described with reference to FIGS. 8 through 10. The sealed end 202 of the bag 204 is presented to the apparatus by a conveyor 206 so that the end 202 is directed generally between the roller brushes 208 and 210 which are rotating, as indicated by the arrows in FIG. 8, so that the end 202 is positively pulled in between the roller brushes 208 and 210, by the action of the brush roller bristles on the end 202 of the bag 204. The roller brushes 208 and 210 advance the end 202 of the bag, from right to left in FIG. 8, until the edge 232 of the end 202 reaches the line 232 at the intersection of the fingers 228 and 230. Upon the end 202 reaching this point, the roller brushes 208 and 210 are no longer operable to advance the end 202 to the left in FIG. 8, and the end 202 is held captive for a moment between the rotating roller brushes 208 and 210. This condition, which is preferably sensed by a sensor (not shown), signals the apparatus 200 to transfer the bag 204 to an attachment station with a base 24, with strip material positioned between the end 202 of the bag 204 and the base 24, as shown in FIG. 2.

The linear actuator 248 has previously been actuated to position the jaw actuator in the first, extended position shown in FIG. 8. The jaw actuator has been actuated to position the jaws in the first, open position illustrated in FIG. 8. A portion of the sealed end 202 is thus positioned between portions of the jaws 242 and 244.

Referring now to FIG. 9, the jaw actuator is actuated to move the jaws 242 and 244, as indicated by the arrows in FIG. 9, into the second, closed position so that the end 202 of the bag 204 is held captive between the jaws 242 and 244. At this time, the linear actuators 220 and 222 are actuated to move the lower and upper arms 212 and 214, and the roller brushes 208 and 210, from the first, closed position to the second, open position, as indicated by arrows in FIG. 9. As the roller brushes 208 and 210 reach the second, open position, which is illustrated in FIG. 10, there is clearance for the bag to be delivered to the base 24. This is accomplished with the actuation of the linear actuator 248 to move the jaw actuator 246, the jaws 242 and 244, and the bag retained thereby, to the second, retracted position shown in FIG. 10. In the retracted position, a portion of the end 202 of the bag 204 is brought into registration with a pre-selected portion of strip material for attachment thereto. The portion of the end 202 can be attached to the strip material by means of the apparatus shown in FIGS. 1 through 5, i.e., by taping. Alternatively, other attachments may be effected, either in the manner described below with reference to FIG. 11, or with other suitable attachment apparatus. At this stage, the apparatus 200 is reset as follows. Strip material with the bag 204 attached thereto is advanced, left to right, to position a new, pre-selected portion of the strip material on the base 24. The linear actuator 248 is actuated to move the jaw actuator 246 and the jaws 242 and 244 to the extended position. The roller brushes 208 and 210 and the arms 212 and 214 are moved, under the action of the actuators 220 and 22, to the closed position shown in FIG. 8. The apparatus is now set for another bag 204 to be advanced into the apparatus, between the roller brushes 208 and 210, and the foregoing cycle is repeated until a desired number of bags have been attached to the strip material. At that time, as described above, the strip material is cut to produce a loaded display strip. Preferably, a hanger is formed in or on the strip, as described above.

Figure 11:
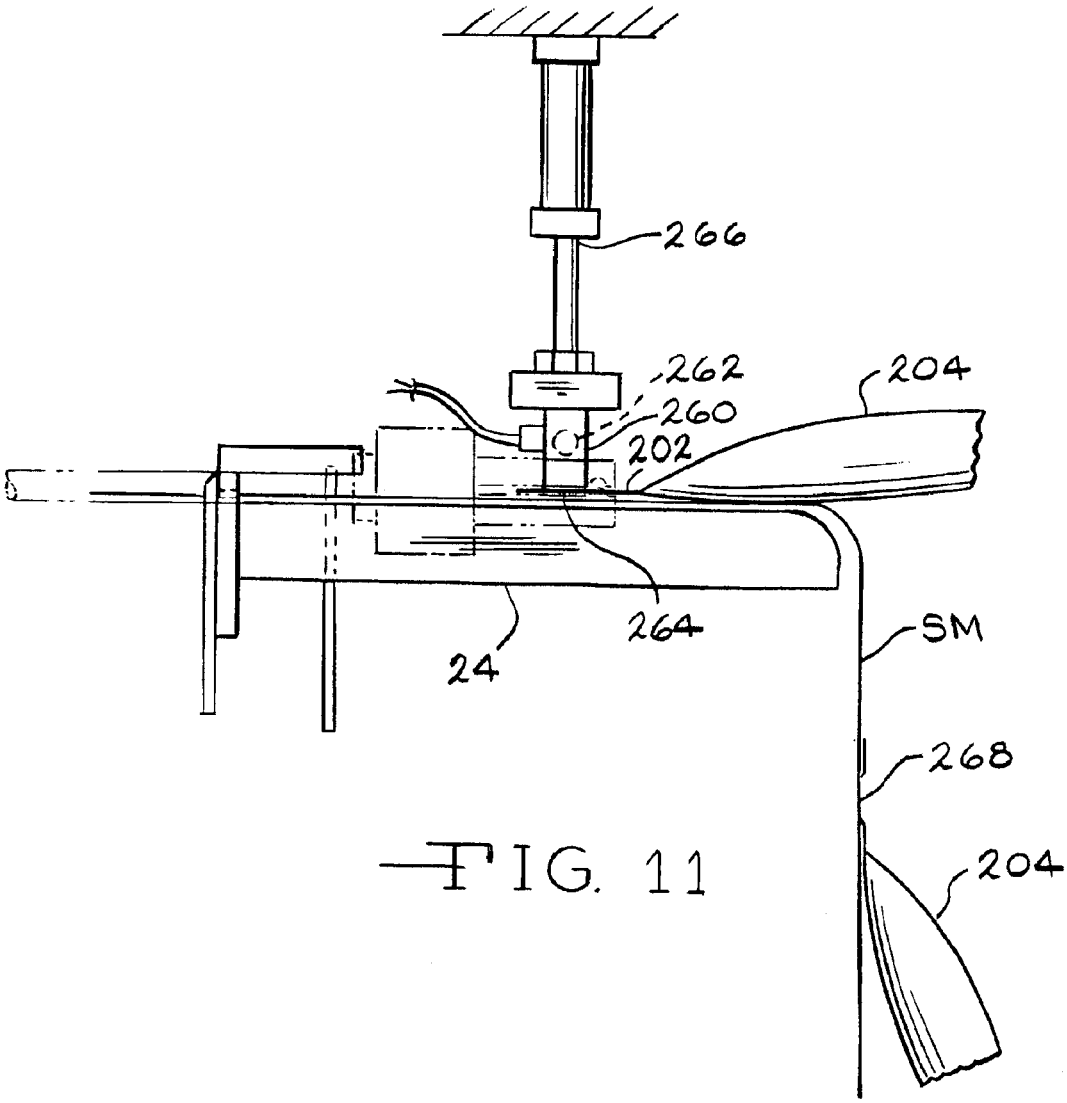
FIG. 11 is a partial side view of apparatus according to the present invention including a heat element for securing a portion of the edge of a bag to a target portion of the strip material.

In a second embodiment of apparatus for producing a display strip, the tape arm, the tape cutter and the tape install pad in the apparatus 10 shown in FIGS. 1 through 5 and/or the apparatus 200 shown in FIGS. 8 through 10, are replaced with other elements for attaching or securing a plurality of items to strip material to produce a display strip according to the present invention. Referring now to FIG. 11, a sealed end 202 of a bag 204 is resting on strip material SM that, in turn, is resting on the base 24. In this case, the strip material SM is heat seal tape or sealable tape to which the sealed end 202 is secured by the application of energy and, specifically, heat energy.

A heat bar 260 comprises a heating element 262 and a heat head 264. The heating element 262 heats the heat head 264 in a known manner and to a temperature sufficient that, when it is brought down to bear on the sealed end 202 of the bag as it rests upon the strip material SM, the end 202 and the strip material are sealed together, as indicated at 268, so that the bag 204 is supported on the strip material SM.

The heat bar is mounted on a linear actuator 266 which is operable to advance the heat bar 260 to a first, extended, sealing position which is illustrated in FIG. 11, and a second, retracted position which is higher than the position illustrated for the heat head 260 in FIG. 11. The heat bar only needs to be retracted a small distance to provide clearance for another end to be registered with the strip material SM.

In a method for producing the display strip with apparatus shown in FIG. 11, the items to be sold are delivered to the station of the apparatus and so is the strip material until a portion of the next item or packaging for the item is adjacent to a pre-selected portion of the strip material. The heat bar 260 is advanced to heat the portion of the next item or packaging for the item, the adjacent portion of the strip material, or both, until the portion of the item or packaging for the item is adhered, secured or attached to the portion of the strip material. The heat bar 260 is retracted and the strip material, with the item secured thereto, is advanced and a fresh portion of the strip material is delivered to the station. A new item is delivered to the station as well, and the previously recited steps are repeated so that a portion of the new item or packaging for the item is secured to the fresh portion of the strip material. Additional items are secured to successive portions of the strip material until a desired number of items are supported on the strip. The strip material is, again, cut to release a loaded display strip from the strip material.

Figure 12:
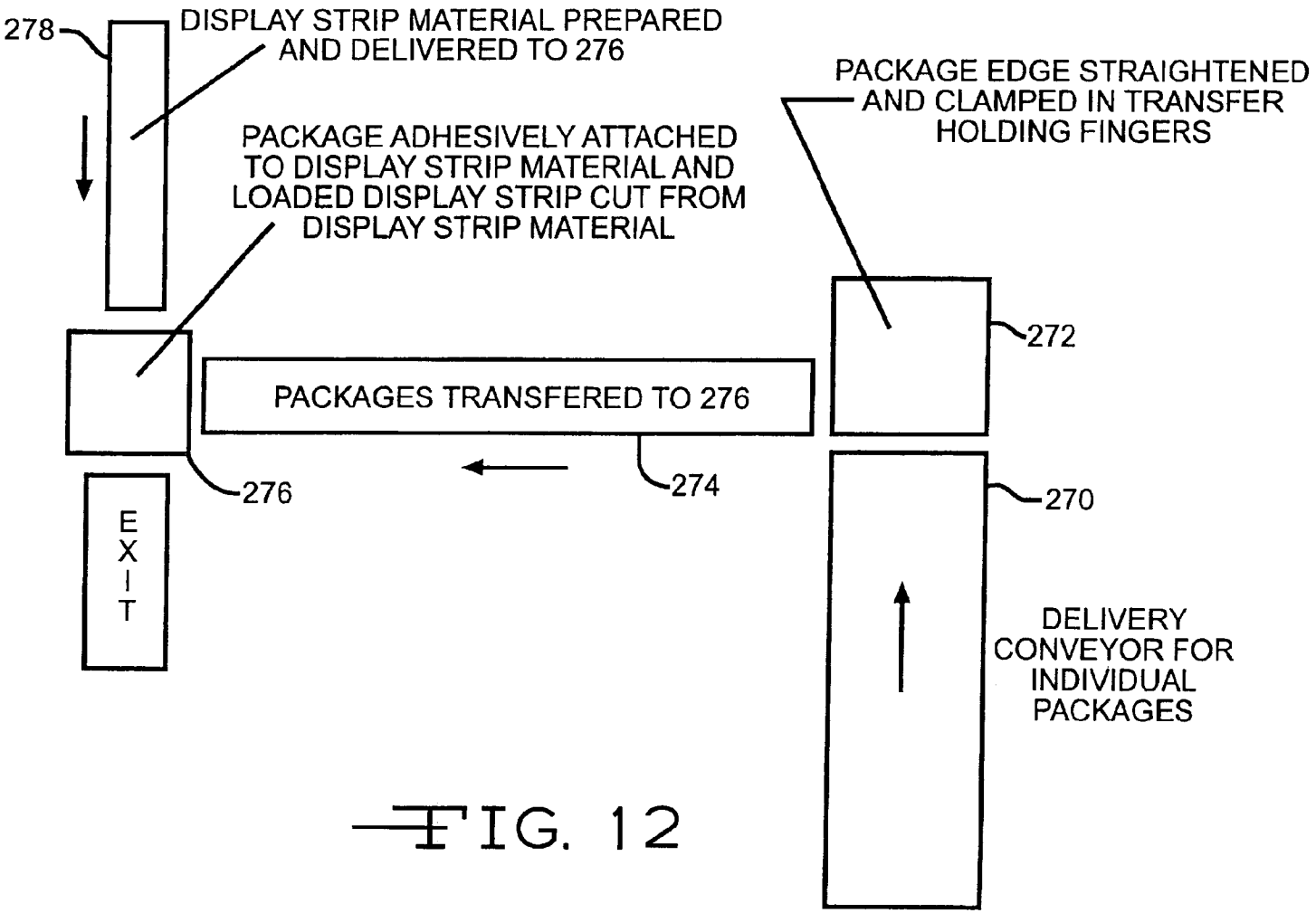
FIG. 12 is a flow chart illustrating the steps in a preferred method for producing a display strip and the stations that constitute preferred apparatus for producing a display strip according to the invention.

Referring now to FIG. 12, a most preferred method for producing a display strip according to the invention is illustrated. Packages of product, especially consumables packaged in sealed bags, are delivered by a conveyor 270 to a first station 272 where one end of the bag is straightened and the straightened end is gripped by transfer holding fingers. A conveyor 274 on which the transfer holding fingers are mounted transfers the packages laterally to a second station 276. A third station 278 is operable to produce display strip material and deliver it to the second station 276. The display strip material comprises strip material with spaced apart apertures formed in the strip material. Adhesive tape is applied a first side of the apertured strip material, so that the adhesive side of the tape is exposed on the second side of the film, through the apertures. The most preferred apparatus for producing a pre-loaded display strip will now be described with reference to FIGS. 13 through 19.

Figure 13:
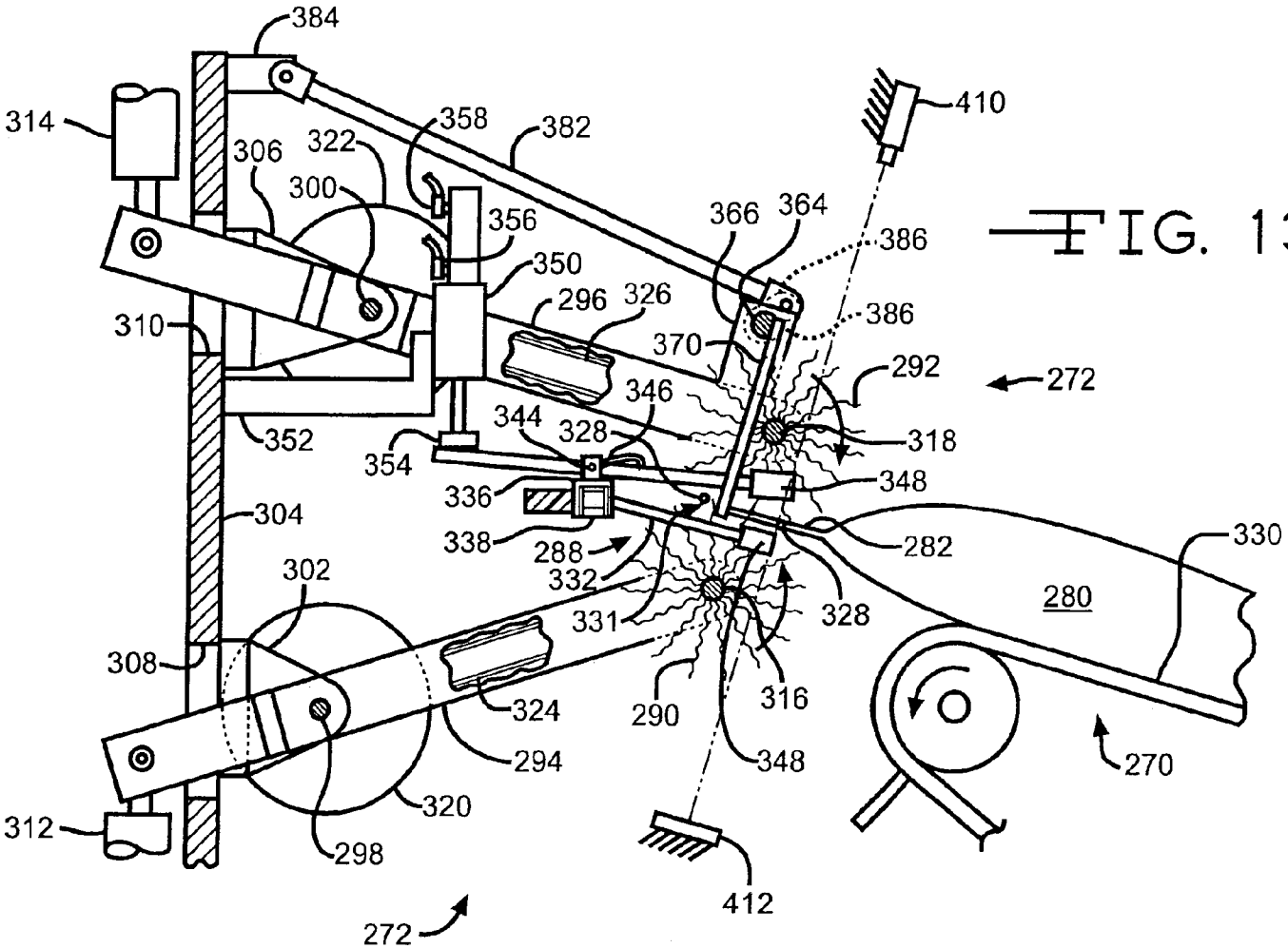
FIG. 13 is a side view, partially in cross section, of the package end straightening and end gripping station of apparatus according to the invention for producing a display strip.
Figure 14:
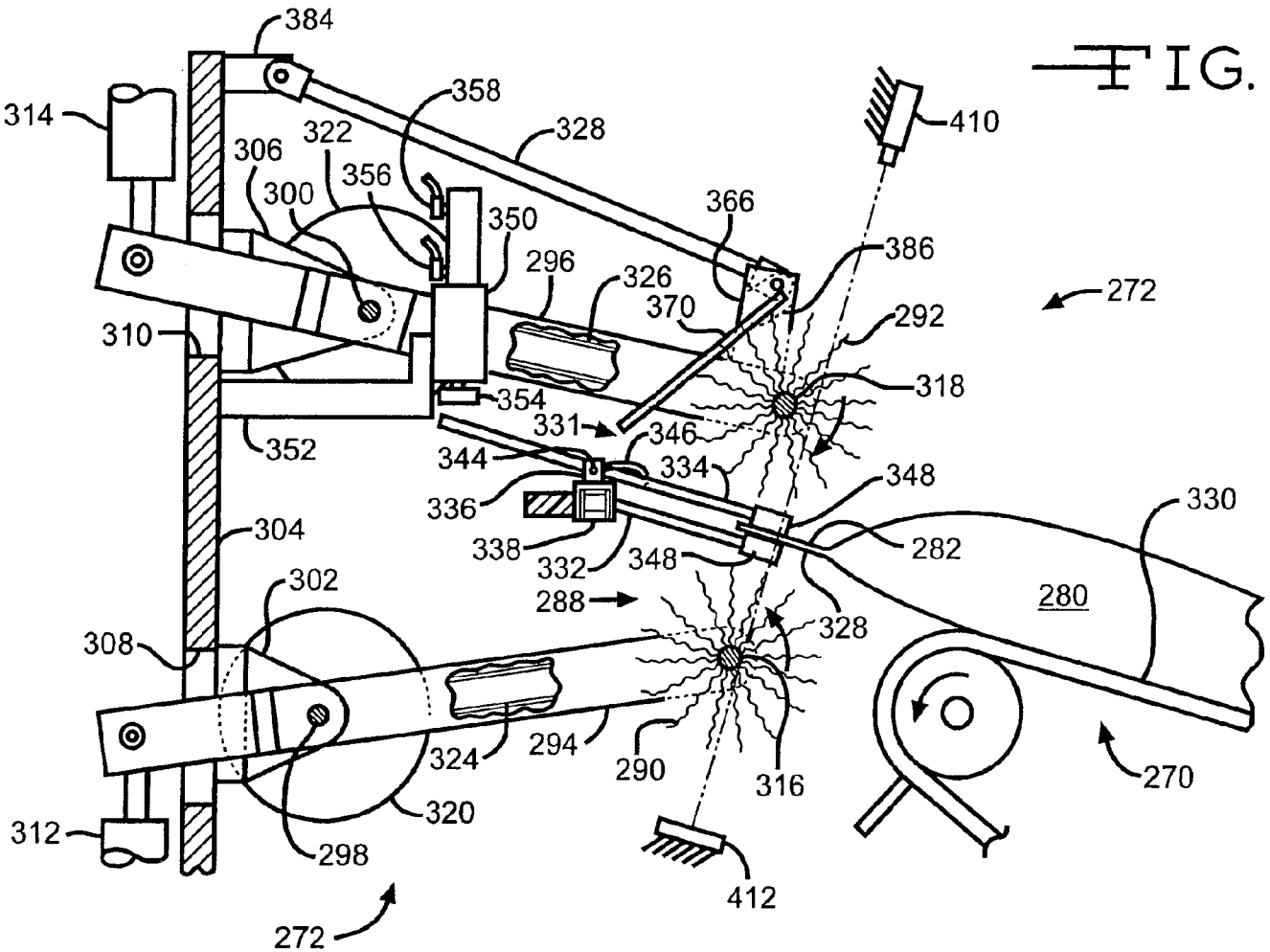
FIG. 14 is a side view, partially in cross section, of the package end straightening and end gripping station shown in FIG. 13, in a different state.

As shown in FIGS. 13 and 14, the conveyor 270 is operable to deliver packages, especially food packages 280 with at least one sealed end 282, to the first station 272. The conveyor 270 advances packages 280 from right to left in these Figs. It is preferred that the conveyor be an indexing conveyor that is operable to advance a package 280 a distance corresponding with one package pocket on the conveyor and to dwell in that position before advancing the package that same distance.

As explained above with reference to FIGS. 8 through 10, the sealed end 282 of a package 280 may be substantially planar and substantially parallel to the conveyor 280 on which it is conveyed, as shown in FIGS. 13 and 14, or the sealed end 282 may not be substantially planar and/or may be cocked or skewed, along with the package 280 itself, relative to the conveyor 270. In either case, the first station 272 is operable to straighten the end 282, if necessary, to straighten the package 280, if necessary, and to engage the end 282 with transfer holding fingers, indicated generally at 288, which maintain the end 282 in a substantially straight and workable orientation.

Figure 15:
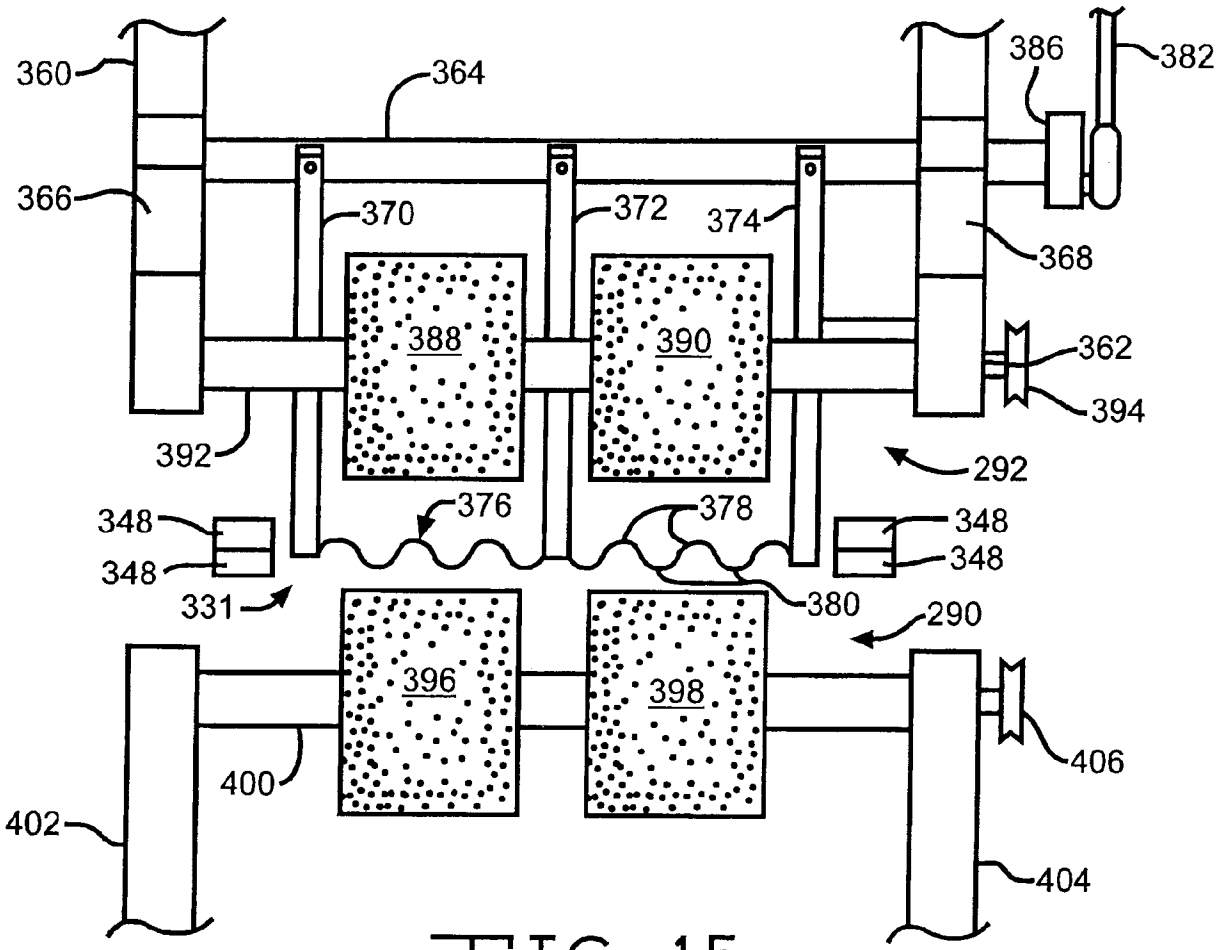
FIG. 15 is a front view of the station shown in FIGS. 13 and 14 showing details of the package end-straightening and end stopping portions of the station.

Referring now to FIGS. 13 through 15, the end straightening portion of the first station 272 comprises a first, lower roller brush assembly 290 and a second, upper roller brush assembly 292, which are mounted on a lower arm 294 and an upper arm 296, respectively. The lower arm 294 is mounted for pivoting movement about a pivot 298 between a first, closed position, shown in FIG. 13, and a second, open position shown in FIGS. 14 and 15. Similarly, the upper arm 296 is mounted for pivoting movement about a pivot 300 between a first, closed position, shown in FIG. 13 and a second, open position shown in FIGS. 14 and 15. The pivot 298 is supported on a bracket 302, which is secured to and supported on a back plate 304. The pivot 300 is supported on a bracket 306, which is also secured to and supported on the back plate 304. A portion of the lower arm 294 extends through an opening indicated at 308 in the back plate 304 and a portion of the upper arm 296 extends through an opening indicated at 310 in the back plate 304.

Movement of the lower arm 294 between the first and second positions is effected by a linear actuator 312 and a linear actuator 314 effects movement of the upper arm 296 between the first and second positions. Portions (not shown) of the linear actuators 312 and 314 are secured to the back plate 304.

The roller brush assemblies 290 and 292 are mounted on the arms 294 and 296 for rotation, in opposite directions, as indicated by arrows, about axes 316 and 318, respectively. Rotation of the brush assemblies 290 and 292 is effected by motors 320 and 322, respectively, by way of drive belts 324 and 326 connecting lower and upper pulleys (not shown) on the drive shafts (not shown) of the motors 320 and 322. The motors 320 and 322 are connected to and supported by the back plate 304, so that their drive shafts (not shown) coincide with the pivot points 298 and 300, respectively. Preferably, as shown in FIG. 13, the pivots 298 and 300 are positioned and the arms 294 and 296 are sized so that, when the arms 294 and 296 are in the first, closed positions, the peripheries of the roller brush assemblies 290 and 292 intersect at two points 328 and so that a line connecting the points of intersection 328 is aligned with the end 282 of a package 280, and is parallel with an upper surface 330 of the conveyor 270. In operation, as an end 282 of a package 280 approaches the roller brush assemblies 290 and 292, the end 282 may be above the first point of intersection 328, in which case the end 282 will be deflected downwardly, towards the first point of intersection 328, by the upper roller brush assembly 292. Alternatively, the end 282 may be below the first point of intersection 328, in which case the end 282 will be deflected upwardly, towards the first point of intersection 328, by the lower roller brush assembly 290. It is also possible that a portion of the end 282 may be above the first point of intersection 328 and that another portion of the end 282 may be below the first point of intersection 328 and, in this case, the portion of the end 282 that is below will be deflected upwardly and the portion of the end 282 that is above will be deflected downwardly. In both cases, the package 280 will be conveyed by the conveyor 270, towards the first point of intersection 328, until the end 282 of the package 280 reaches the first point of intersection 328, at which point the end 282 of the package 280 will be frictionally engaged between the roller brush assemblies 290 and 292 and will be advanced, from right to left in FIG. 13, until the end 282 reaches a stop assembly indicated generally at 331, which stops the end 282 from advancing, right to left, any further, despite the rotation of the roller brush assemblies 290 and 292 and their frictional engagement with the end 282. This condition is illustrated in FIG. 13. The details of construction and operation of the stop assembly 331 will be described in more detail below with reference to FIG. 15.

When the end 282 of the package 280 is stopped in the position shown in FIG. 13, the end 282 is positioned between transfer holding fingers 288 and, specifically, between a pair of lower transfer holding fingers 332, one of which is shown in FIGS. 13 and 14, and a pair of upper transfer holding fingers 334, one of which is shown in FIGS. 13 and 14. The transfer holding fingers 288 are supported on mounting brackets 336, which, in turn, are secured to and supported on links, one of which is shown at 338 in FIGS. 13 and 14, of a transfer chain 340 (FIG. 16) which is driven sequentially by a pair of gears, one of which is shown at 342 in FIG. 16. The lower transfer holding fingers 332 are fixed, relative to the mounting brackets 336 while the upper transfer holding fingers 334 are mounted for pivotal movement about a pivot 344. A spring 346 biases the upper transfer holding fingers 334 for movement from an open position shown in FIG. 13 to a closed or gripping position shown in FIGS. 14 and 16. It is preferred that resilient covers 348 be secured to and supported on a first end of the lower and upper transfer fingers 332 and 334. As described below with reference to FIG. 14, the resilient covers 348 engage the end 282 of packages 280.

A linear actuator 350 is supported on a bracket 352, which, in turn, is secured to and supported on the back plate 304. An extendable plunger 354 is supported in the linear actuator for reciprocating movement between a first, extended position shown in FIG. 13 to a second, retracted position shown in FIG. 14. When the plunger 354 is extended, as shown in FIG. 13, it overcomes the bias of the springs 346 and causes the two upper transfer holding fingers 334 in the station 272 to pivot to the open position. When the plunger is retracted, as shown in FIG. 14, the springs 346 cause the upper transfer holding fingers 334 to pivot to the gripping position shown in FIG. 14. The linear actuator 350 is pneumatic, as suggested by the pneumatic couplings 356 and 358, although it will be appreciated that other types of linear actuators may be employed.

The stop assembly 331 is shown in more detail in FIG. 15, a front view, i.e., looking from right to left in FIGS. 13 and 14, of the some elements of the station 272, namely, the arms 294 and 296, the roller brush assemblies 290 and 292, the stop assembly 331 and the resilient covers 348 on the transfer holding fingers. The arms 294 and 296 and the roller brush assemblies 290 and 292 are shown in the open position, the resilient covers 348 are shown in a closed position, and the stop assembly 331 is shown in a stop position. It should be noted here that, when the arms 294 and 296 are in the open position, the stop assembly 331 is in a retracted position, as shown in FIG. 14. Similarly, when the arms 294 and 296 are in the closed position, the stop assembly 331 is in the stop position, as shown in FIG. 13. Accordingly, the position of the elements depicted in FIG. 15 has been selected to illustrate some relationships between the roller brush assemblies 290 and 292 and the stop assembly 331, contrary to their relative positions during the preferred mode of operation of the station 272.

Where the upper arm 296 supports the upper roller brush assembly 292, the upper arm 296 comprises a first arm 360 and a second arm 362 spaced therefrom, as shown in FIG. 15. The stop assembly 331 comprises a rod 364, which is mounted for rotation in a bracket 366, which is secured to and supported on the first arm 360, and in a bracket 368, which is secured to and supported on the second arm 362. The stop assembly 331 further comprises a first strut 370, a second strut 372 and a third strut 374. A first end of each of the struts 370, 372 and 374 is secured to the rod 364 for rotation therewith between a first, stop position, illustrated in FIGS. 13 and 15, and a second, retracted position shown in FIG. 14. A serpentine stop wire 376 is secured to a second end of each of the struts 370, 372 and 374. The stop wire has high points 378 and low points 380. When the stop assembly 331 is in the stop position shown in FIG. 13, the points of intersection 328 between the peripheries of the roller brush assemblies 290 and 292 are spaced from but between the high points 378 and the low points 380 of the serpentine stop wire 376. Further, the low points 380 and the high points 378 extend inside of the peripheries of the lower and upper roller brush assemblies 290 and 292 when the stop assembly 331 is in the stop position shown in FIG. 13, thereby providing a positive stop for stopping the end 282 of the package 280 from advancing. Excellent results have been achieved with a stop wire 376 having a diameter of three sixteenths of an inch (about 0.5 cm) and a distance from high points 380 to low points 378 of five sixteenths of an inch (about 0.8 cm).

Movement of the stop assembly between the stop position (FIG. 13) and the retracted position (FIG. 14) is effected by a bell crank linkage comprising a linkage arm 382 pivotally secured at one end to a bracket 384, which, in turn, is secured to and supported on the back plate 304, well above the bracket 306. The other end of the linkage arm 382 is pivotally secured to a bell crank 386 which is secured to and supported on the rod 364. When the upper arm 296 is in the closed position (FIG. 13), the linkage arm 382 positions the rod 364 so that the stop assembly 331 is in the stop position shown in FIGS. 13 and 15. When the upper arm 296 is pivoted from the closed position to the open position (FIG. 14), the linkage arm 382 causes the rod 364 to rotate, thereby moving the stop assembly from the stop position (FIGS. 13 and 14) to the retracted position as shown in FIG. 14. In the retracted position, the stop assembly 331 does not interfere with the lateral movement of the chain 340 (FIG. 16) or of the transfer holding fingers 288.

Referring again to FIG. 15, the upper roller brush assembly 292 comprises a first roller brush 388 and a second roller brush 390, which are secured to and supported on a rod 392 rotatably supported in the first arm 360 and the second arm 362. The rod 392 and the roller brushes 388 and 390 are rotated by the upper drive belt 326 (FIGS. 13 and 14) acting through a pulley 394 (FIG. 15). Similarly, the lower roller brush assembly 290 comprises a first roller brush 396 and a second roller brush 398, which are secured to and supported on a rod 400 rotatably supported in a first arm 402 and a second arm 404 at the brush end of the lower arm 294. The rod 400 and the roller brushes 396 and 398 are rotated by the lower drive belt 324 (FIGS. 13 and 14) acting through a pulley 406 (FIG. 15). For packages having an end that is five inches (13 cm) wide, excellent results have been obtained with roller brushes having a width of one and one half inches (4 cm) and a diameter of four inches (10 cm). The roller brush 388 is spaced about one half inch (1 cm) from the roller brush 390 to provide clearance for the second strut 372 of the stop assembly 331. The roller brush 388 is spaced about one inch (2.5 cm) from the arm 360 to provide clearance for the first strut 370 and the resilient covers 348 on the transfer holding finger. Similarly, the roller brush 390 is spaced about one inch (2.5 cm) from the arm 362 to provide clearance for the third strut 374 and the resilient covers 348 on the transfer holding fingers. Good results have been achieved with the roller brushes 388, 390, 396 and 398 rotating at a rate of 150 revolutions per minute. This causes the peripheries of the roller brushes to travel at a rate of about 2.6 feet per second. Under these conditions, the conveyor 270 (FIGS. 13 and 14) is preferably set to move packages 280 at a rate in the range of about of about 2.5 feet per second. Good results have been achieved with roller brushes having bristles that are about one one-hundredth of an inch in diameter and a little more than one inch in length. In this case, good results have been achieved where the two points of intersection 328 between the peripheries of the roller brush assemblies 290 and 292 were spaced about one half inch (1.3 cm) from each other.

Referring again to FIGS. 13 and 14, a sensor comprises a photo-eye 410, which cooperates with a reflector 412 to produce a signal when an end 282 passes between them under the action of the conveyor 270. The signal produced initiates an operation sequence for the station 272, as described in more detail below.

Figure 16:
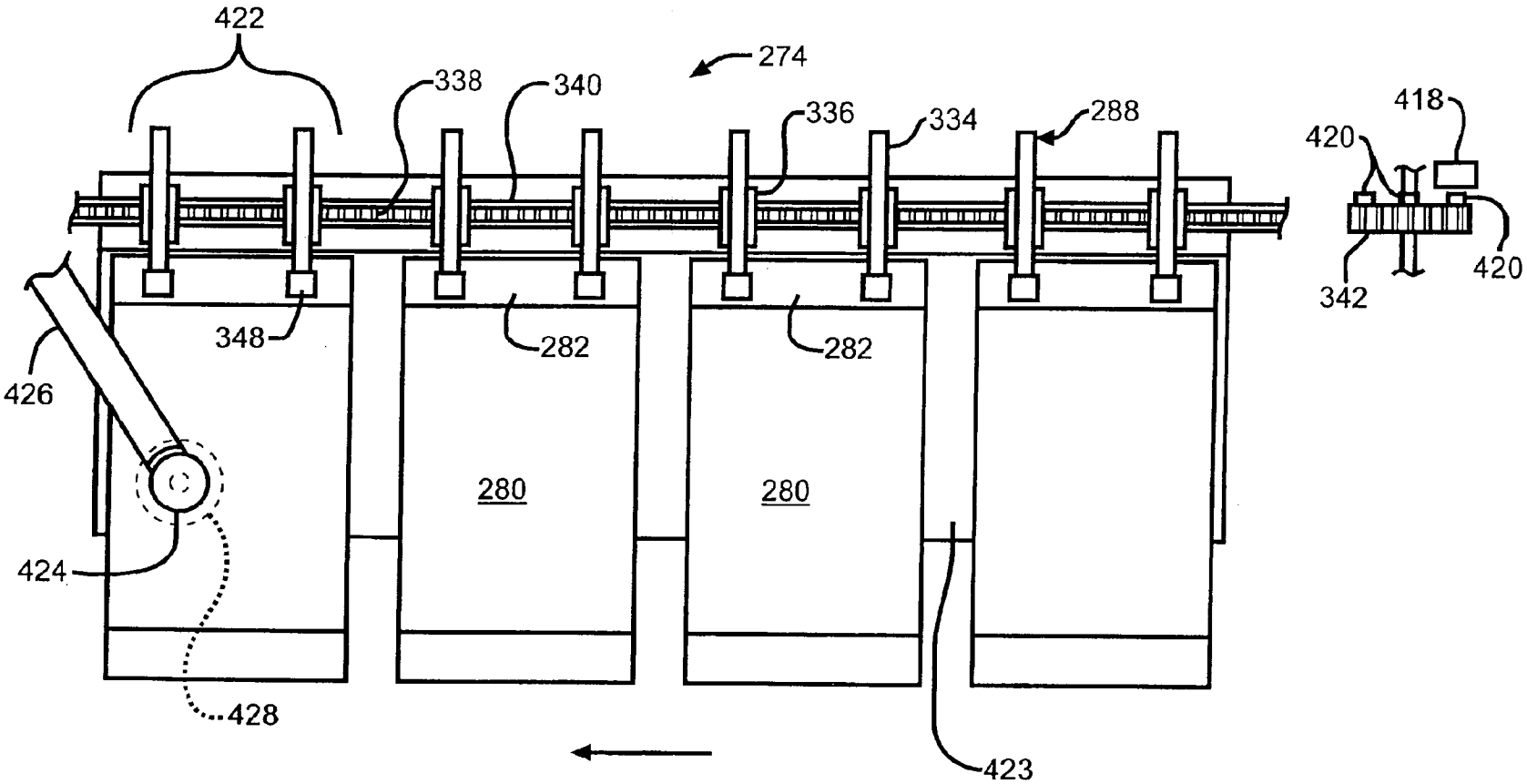
FIG. 16 is a top view of a conveyor station for conveying packages with straightened ends to a station where they are adhesively secured to display strip material.

Referring now to FIG. 16, a conveyor indicated generally at 274 is operable to transfer packages 280 from the station 272 to the second station 276 for adhesive attachment to display strip material. The conveyor 274 comprises a chain 340 made up of links 338. The chain 340 is supported on and driven by a pair of gears, one of which is indicated at 342. A plurality of transfer holding fingers 288 comprising upper transfer holding fingers 334 and lower transfer holding fingers 332 (FIGS. 13 and 14; not visible in FIG. 16) are secured to and supported on brackets 336 which, in turn, are supported on the links 338 of the chain 340.

The conveyor 274 is operable to position a given pair of upper and lower transfer holding fingers 288 in the first station 272, on either side of the roller brush assemblies 290 and 292, and hold them there at least long enough to engage an end 282 of a package 280. When an end 282 is so engaged, a signal is produced and is operable to activate a motor (not shown) to turn the gear 342 to advance the given pair of upper and lower transfer holding fingers 288 and the package 280 engaged thereby, from right to left in FIG. 16, to a position formerly occupied by the pair of upper and lower transfer holding fingers immediately to the left of the given pair, and stop, thereby positioning a next pair of upper and lower transfer holding fingers 288 in the first station 272. The sequencing of the conveyor 274 is achieved, in part, by means of a proximity switch 418 and a plurality of bumpers 420 secured to and supported on the gear 342. In the embodiment illustrated in FIG. 16, four bumpers 420 are positioned near the periphery of the gear 342, at ninety-degree intervals from each other. The motor (not shown), when activated, turns the gear 342 until the next bumper 420 is adjacent to the proximity switch 418, which produces a signal causing the motor (not shown) to deactivate until another signal is produced to indicate that the next pair of upper and lower transfer holding fingers have engaged an end of a package in the station 272. Eventually, a package 280 is transferred from the station 272 to an on-deck position indicated at 422. During this transfer, a portion of the package 280 is supported in a generally horizontal position by a ledge 423. A photo-eye 424 is supported on a bracket 426 and cooperates with a reflector 428 to produce a signal whenever a package 280 is in the on-deck position 422. This signal is integrated into the control of the operations of the stations 276 and 278, which are described below.

Figure 17:
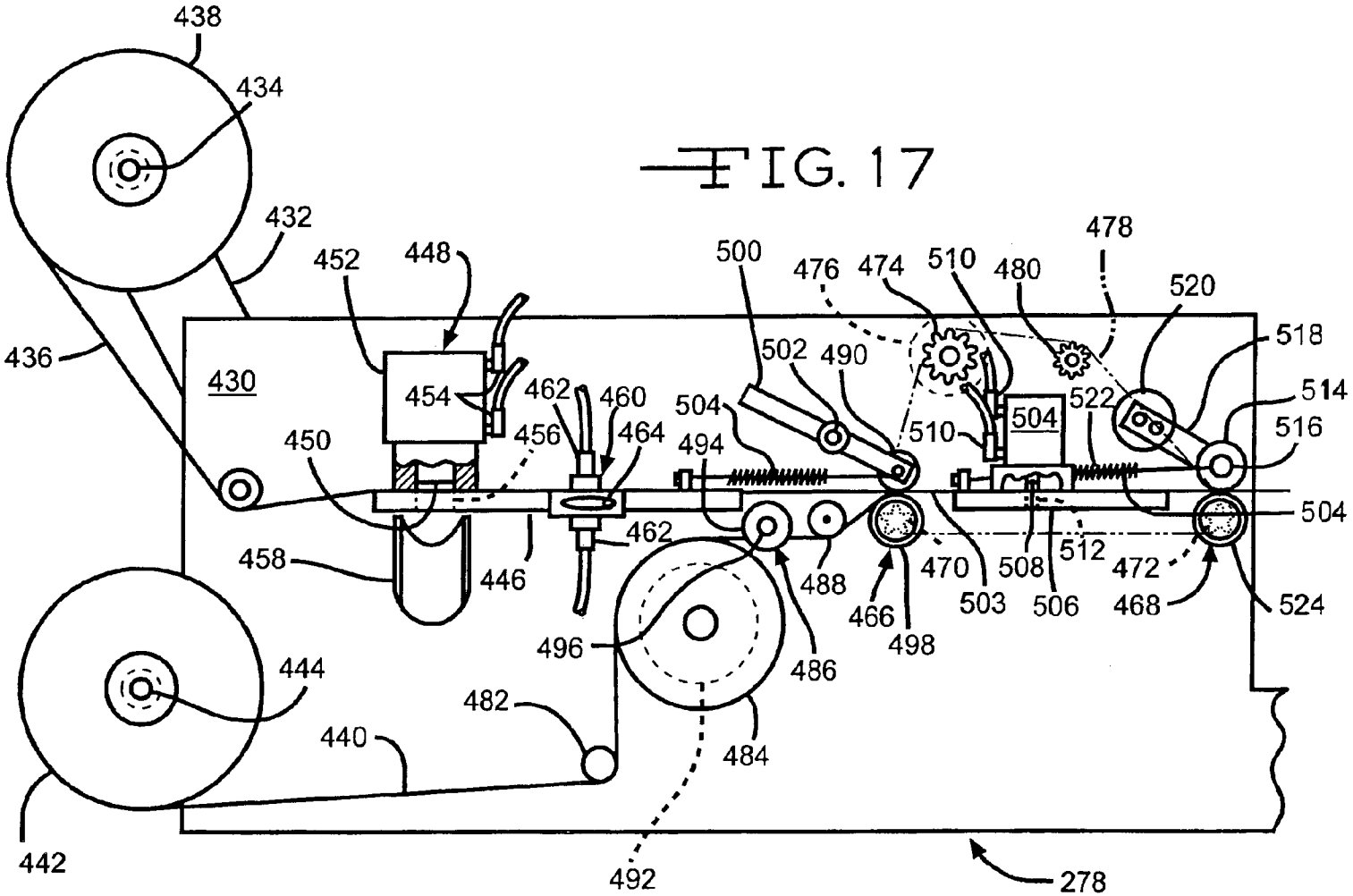
FIG. 17 is a side view of a station for producing display strip material.

Referring now to FIG. 17, a station, for producing display strip material, to which packages can be adhesively secured, is indicated generally at 278. The display strip material comprises a strip of material, preferably a polymeric material, having a first side and a second side, with a plurality of holes there through, uniformly spaced apart, and a piece of tape with adhesive on one side, with the tape adhesively secured to the second side of the strip, so that adhesive is exposed from the first side of the strip, through the holes. Preferably, the strip and the tape are generally co-extensive. Means for hanging a display strip made from the display strip material, such as an aperture, are preferably formed at one end thereof in the station 278.

The station 278 comprises a side plate 430 with a support 432 secured thereto for a spindle 434 for supporting a supply of strip material 436 in roll form, indicated at 438. A supply of adhesive tape 440, in roll form indicated at 442, is supported on a spindle 444, which is carried by a support (not shown) secured to the side plate 430. Strip material 436 is fed from the roll 438 and passes over a strip support 446 and between the strip support 446 and a hole puncher, indicated generally at 448, which is secured to and supported on the support 446. The hole puncher 448 comprises a punch 450 mounted for reciprocating movement in a housing 452. A pneumatically powered linear actuator (not shown) is mounted inside of the housing 452 and is operable to reciprocate the punch 450. Pneumatic couplings 454 are connected to the housing 452 and to the linear actuator (not shown). An opening, indicated at 456, is provided in the strip support 446 so that a piece of the strip material 436 that is cut out of the strip material 436 by the hole puncher 448 can pass through the strip support 446 and onto and down a chute 458 for collection and/or disposal.

An air switch 460 is downstream from the hole puncher 448 and is secured to and supported on the support 446. A longitudinally extending slot (not shown) is provided through the support 446, in the vicinity of the air switch 460. Pneumatic couplings 462 deliver air to and from the switch 460, whenever a hole punched in the strip material 436, by the hole puncher 448 registers with the air switch 460 and the slot (not shown) through the support 446. The flow of air through the switch 460 is used as a signal to control, in part, the operation of the station 278, as described below in more detail. The longitudinal position of the air switch 460 is adjustable and the air switch 460 can be secured to the support in a variety of longitudinal positions by means indicated generally at 464, so that an operator can determine the distance between the air switch 460 and the hole puncher 448. This distance, as explained below in more detail, will determine the spacing between product placement holes punched in display strip material produced by the station 278. When a portion of strip material 436, without a hole punched through it, registers with air switch 460, the flow of air through the air switch 460 is prevented, and this condition also is used as a signal to control the operation of the station 278.

Intermittent movement of strip material 436 and of adhesive tape 440 through the station 278 is effected by a first drive roller 466 and a second drive roller 468. A gear 470 is drivingly connected to the drive roller 466 and a gear 472 is drivingly connected to the drive roller 468. A drive gear 474, driven by a motor 476 mounted on and behind the side plate 430, is drivingly connected to the gears 470 and 472 by a drive chain indicated at 478. The drive chain 478 passes over an idler gear 480.

Adhesive tape 440 passes over a first tape roller 482, over a tape drive assist wheel 484, through a tape guide 486, over a second tape roller 488 and between the first drive roller 466 and a first pressure roller 490. The adhesive side of the tape 440 contacts the roller 482 as well as the roller 488. To prevent the adhesive from adhering to these rollers, they are coated with a non-stick plasma coating, specifically, a 936 plasma coating available from a company called Plasma Coatings. The tape drive assist wheel 484 has an outer surface (not shown) that is knurled. The wheel 484 is rotated, constantly, by a motor 492, which is mounted on and behind the side plate 430. The tape guide 486 comprises a pair of spaced apart washers 494 threadedly mounted on a spindle 496 so that the distance between the washers 494 can be varied to accommodate various widths of tape. The tape 440 is guided by co-action with the inside surfaces (not shown) of the washers 494.

The first drive roller 466 has a coating 498 of neoprene rubber to provide a good friction surface. The strip material 436 and the adhesive tape 440 are pressed together between the drive roller 466 and the pressure roller 490, which is mounted for rotation at the end of an arm 500, which, in turn, is mounted for pivotal movement about a pivot 502. A spring 504 biases the pressure roller 490 towards the drive roller 466 so that the pressure roller 490 presses the strip material 436 and the adhesive tape 440 down against the drive roller 466. The pressure exerted by the pressure roller 490 serves to enhance the frictional engagement between the neoprene coating 498 on the drive wheel 466 and the adhesive tape 440, as well as to adhesively bond the adhesive tape 440 to the strip material 436. The strip material 436 and the adhesive tape 440 exit from between the pressure roller 490 and the drive roller 466, integrated into display strip material 503.

Downstream from the first drive roller 466, a second hole puncher 504 is secured to and supported on a display strip material support 506. The second hole puncher 504 has a reciprocating punch 508, which is actuated by a pneumatically powered linear actuator (not shown), which is served by pneumatic fittings 510. An opening, indicated at 512, is provided in the display strip material support 506 so that a piece of the display strip material 503 that is cut out of the display strip material 503 by the hole puncher 504 can pass through the display strip material support 506 for collection and/or disposal.

Downstream from the second hole puncher 504, the second drive roller 468 cooperates with a second pressure roller 514 to intermittently advance the display strip material 503 from left to right in FIG. 17. The second pressure roller 514 comprises a pair of rollers that are very narrow at their circumferences and are mounted on a spindle 516, which is supported at one end of a pivot arm 518. The other end of the pivot arm is connected to a carrier 520, which is pivotally supported on the side plate 430. A spring 522 biases the pressure roller 514 towards the drive roller 468 so that the pressure roller 514 presses the display strip material 503 down against the drive roller 468, which, like the drive roller 466, has a neoprene coating 524. The pressure exerted by the pressure roller 514 serves to enhance the frictional engagement between the neoprene coating 524 on the drive wheel 468 and the adhesive tape 440 on the lower side of the display strip material 503. It is preferred that the pair of rollers that constitute the pressure roller 514 be spaced apart a distance that is less than the width of the adhesive tape 440 so that the pressure roller presses the edges of the adhesive tape against the strip material 436.

When the drive rollers 466 and 468 are rotated, the adhesive tape 440 will be tensioned where it passes over the tape drive assist wheel 484, increasing the friction between the adhesive tape 440 and the knurled surface (not shown) of the tape drive assist wheel 484. This frictional engagement assists in driving the tape 440 and in overcoming the adhesion between the adhesive on the adhesive tape 440 and an adjacent layer of adhesive tape 440 on the roll 442. Details of the preferred operation of station 278 are described below, following a description of station 276.

Figure 18:
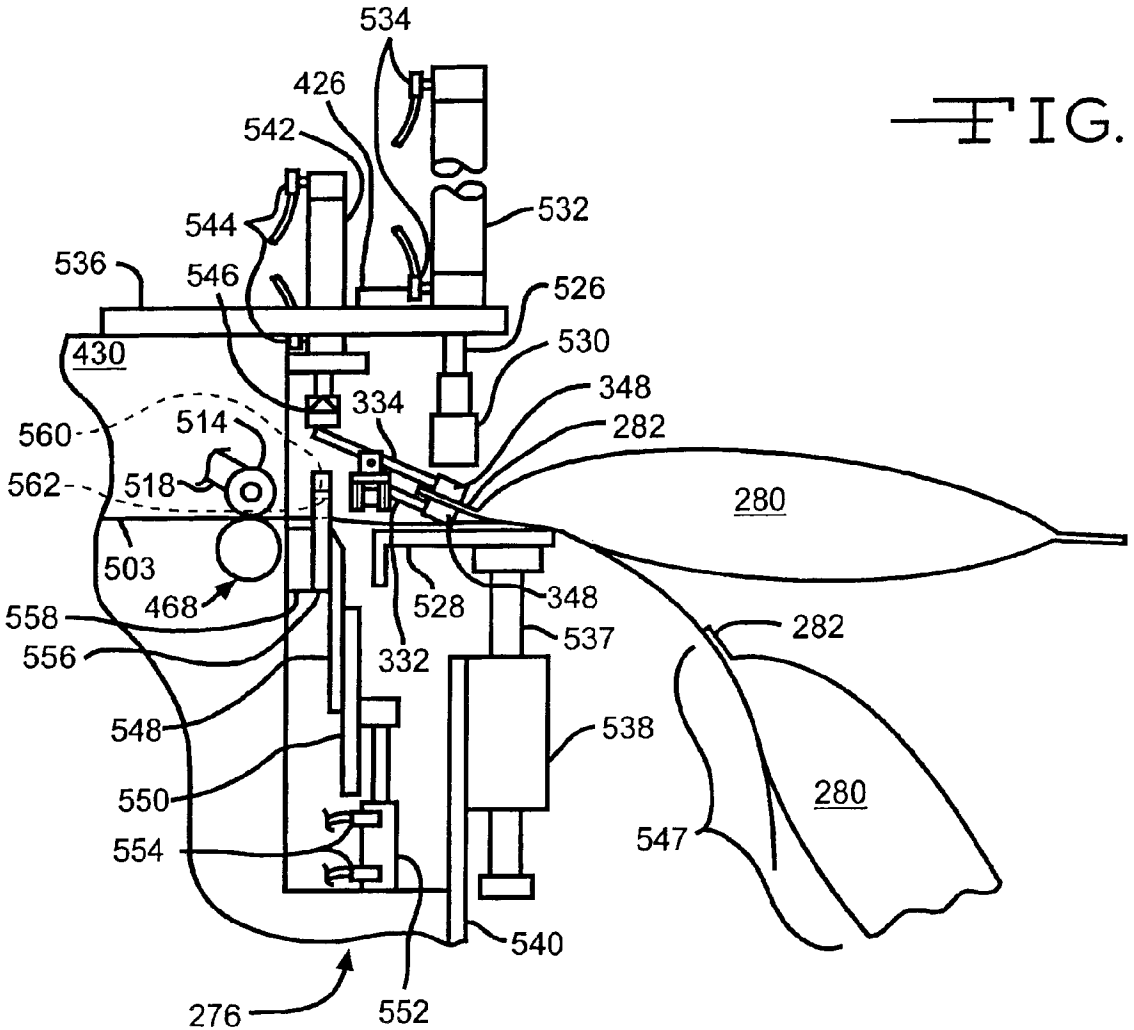
FIG. 18 is a side view of a station for receiving display strip material and packages, adhesively securing the packages to the display strip material and severing a pre-loaded display strip from the display strip material.
Figure 19:
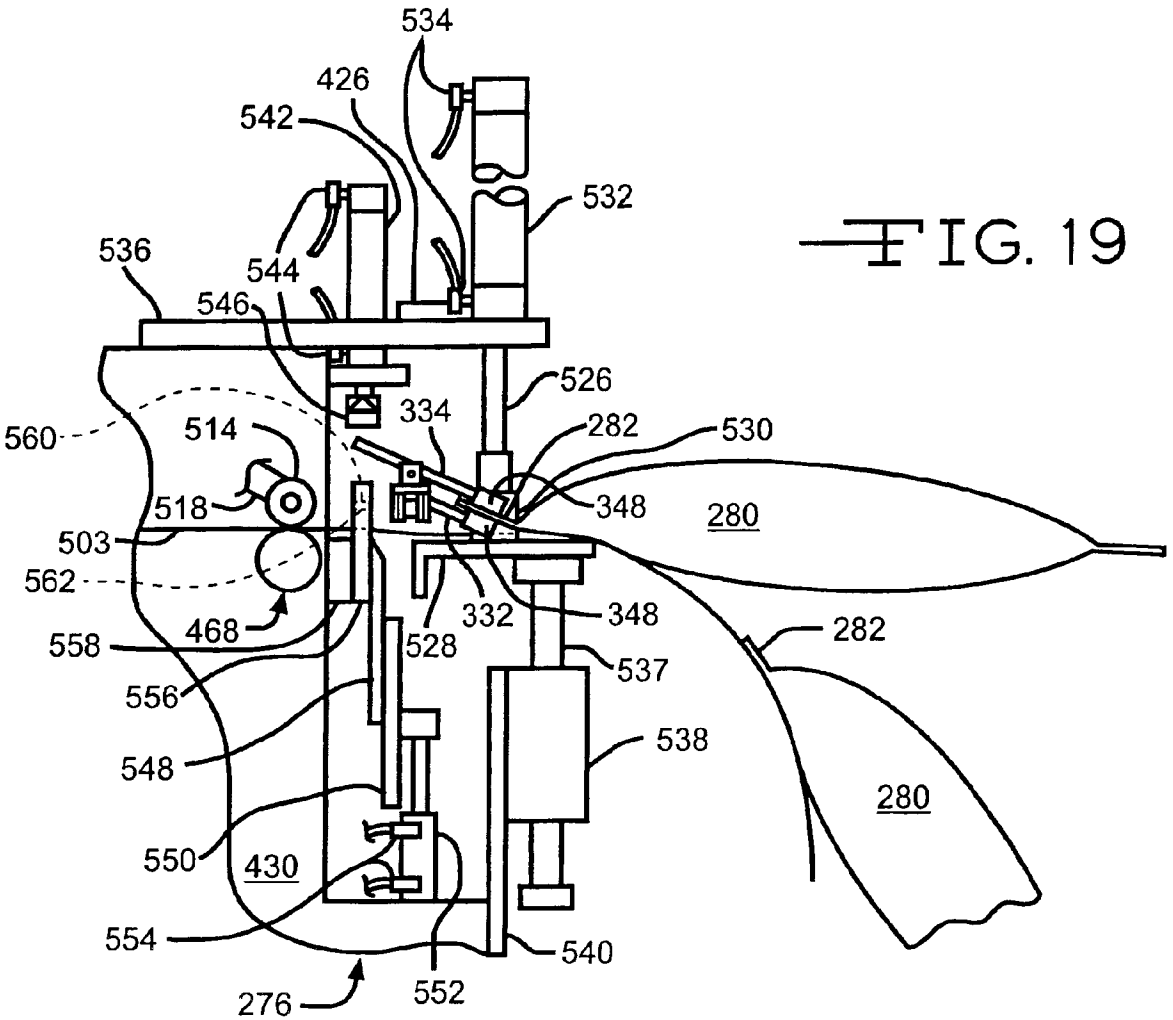
FIG. 19 is a side view of the station shown in FIG. 18, in a different state.

Referring now to FIGS. 18 and 19, the station 276 for attaching a package 280 to exposed adhesive tape 440 on the display strip material 503 comprises a reciprocating plunger 526 and an anvil 528. The plunger 526 has a resilient cover 530 (FIG. 18) at one end and is operably connected to a pneumatically powered linear actuator 532, which includes pneumatic couplings 534. The actuator 532 is secured to and supported on a bracket 536 which is secured to and supported on the side plate 430. The linear actuator 532 is operable to reciprocate the plunger 526 between a retracted position shown in FIG. 18 and an extended position shown in FIG. 19.

The anvil 528 is secured to and supported on a rod 537, which is part of an air spring 538. The air spring 538 is secured to and supported on a bracket 540, which, in turn, is secured to and supported on the side plate 430. The air spring 538 allows the anvil 528 to give just a little when the plunger 526 impacts the anvil 528, thereby reducing the wear and tear on the plunger 526 and the linear actuator 532.

The conveyor 274 (FIG. 16) is operable to convey a package 280 from the on-deck position 422 into the station 276 (FIGS. 18 and 19) and into a position where the end 282 of the package 280 is positioned between the anvil 528 and the plunger 526. The end 282 of the package 280 is held by a set of two upper transfer holding fingers 334 and two lower transfer holding fingers 332 and, with the package 280 positioned between the plunger 526 and the anvil 528, the plunger 526 is spaced from but between the set of two upper and two lower fingers, 334 and 332. The station 278 (FIG. 17) is operable to advance display strip material 503 into station 276 and to position an exposed piece of adhesive tape 440 directly under the plunger 526. At this point, the plunger 526 is advanced to the extended position (FIG. 19), driving a central portion of the end 282 of the package 280 onto the exposed adhesive tape 440 in the display strip material 503, and against the anvil 528. The plunger 526 brings substantial pressure to bear on the end 282 of the package 280, causing the end 282 to become firmly adhered to the exposed adhesive tape 440. The plunger 526 will displace the central portion of the end 282 of the package 280, and cause some slipping between the end 282 and the set of two upper and two lower transfer holding fingers, 334 and 332, that grip the end 282.

Once the plunger 526 reaches the extended position, the end 282 of the package 280 is firmly adhered to the display strip material 503 and the end 282 can be released from the grip of the set of two upper and two lower transfer holding fingers 334 and 332. A pneumatically powered linear actuator 542 is secured to and supported on the bracket 536. The actuator 542 includes pneumatic couplings 544 and carries a bar 546 which is moved by the actuator 542 between a retracted position, shown in FIGS. 18 and 19, to an extended position (not shown). As the bar 546 moves to the extended position (not shown), it causes the upper transfer holding fingers 334 that are in the station 276 to pivot to the open position (as in FIG. 13), thereby releasing the end 282 of the package 280. At this point, the station 278 (FIG. 17) is actuated to advance display strip material 503 to the right in FIGS. 18 and 19, thereby positioning a new or next exposed portion of adhesive tape 440 directly under the plunger 526, causing the package 280 that was on the anvil 528 to advance to the position indicated at 547, once removed from the station 276. The bar 546 is retracted and the conveyor 274 is actuated to advance the next pair of transfer holding fingers 288, with or without a package 280, into the station 276 from the on-deck position 422.

Packages 280 are adhesively secured in this manner to the display strip material 503 until a desired number of packages 280 have been adhesively attached to the display strip material 503. At this point, before the station 278 is activated to advance display strip material 503 towards the anvil 528, a cutter blade 548 is moved from a retracted position, shown in FIGS. 18 and 19, to an extended position, severing a completed, filled display strip (not shown) from the display strip material 503. The cutter blade 548 is secured to and supported on a bracket 550 which, in turn, is secured to and supported on a pneumatically powered linear actuator 552 which is operable to move the cutter blade 548 between the extended position (not shown) and the retracted position shown in FIGS. 18 and 19. The actuator 552 is provided with pneumatic couplings 554 and is secured to and supported on the side plate 430. The cutter blade 548 cooperates with a plate 556 that is secured to and supported on a bracket 558 that, in turn, is secured to and supported on the side plate 430. The plate 556 is wider than the display strip material 503 and has a central opening (not shown) through which the display strip material 503 passes. The central opening in the plate 556 has a high point 560 in the center of the opening and the upper edges of the opening are indicated at 562. Because of the configuration of the central opening in the plate 556, the cutter blade 548, as it moves from the retracted position to the extended position, first cuts the edges of the display strip material 503 and then cuts the center of the display strip material 503 near the high point 560 of the central opening.

The conveyor is preferably associated with a bagger (not shown) which is operable to form packages out of a continuous supply of tubular packaging material, by sealing one end of the package, filling the package with product, sealing a leading end of the package and severing the sealed package from a the package material. The bagger is set to drop a completed package into a pocket of the conveyor 270 and to signal the conveyor 270, when a package is sensed in the pocket, to index the conveyor 270 to bring an open conveyor pocket to the bagger and to advance the pocket with the completed package in it one position to the left, in FIGS. 13 and 14. Eventually, when the package 280 reaches the top of the conveyor 270, the roller brush assemblies 290 and 292 engage the end 282 and, at this point, the conveyor 270 stops and dwells until a next package 280 is deposited in the conveyor pocket at the bagger, or manually, if that is the case. In the meantime, the sensor comprising the photo-eye 410 and the reflector 412 senses the end 282 of the package 280 just before it is engaged by the roller brush assemblies 290 and 292, and the sensor generates a control signal that (a) activates the actuator 350 causing the plunger 354 to move to the retracted position (FIG. 14) so that the springs 346 are operable to cause the upper transfer holding fingers 334 to pivot to a closed position (FIG. 14) and (b) activates the actuators 312 and 314 to move to the extended position, thereby causing the upper and lower arms 294 and 296 to pivot to the open position (FIG. 14). It has been determined that if (a) and (b) are triggered simultaneously, the linear actuator reacts more quickly so that the transfer holding fingers 334 and 332 engage the end 282 of the package before it is released from the roller brush assemblies 290 and 292. As the arms 294 and 296 move to the open position, the stop assembly 331 pivots, under the action of the bell crank 386, from the stop position (FIGS. 13 and 15) to the retracted position (FIG. 14). A magnetic proximity switch (not shown) is located inside of the linear actuator 314 and is operable to generate a signal when the arm 296 has reached the open position (FIG. 14). This signal is used to actuate the motor (not shown) that drives the gear 342 in the conveyor 274 and, as described above, the gear 342 will rotate one-quarter turn until the proximity switch 418 senses that the next bumper 420 is adjacent to it. The switch 418 then generates a signal that stops the conveyor 274 after a package 280 has advanced one position. The signal from the proximity switch 418 is also used to reset the station 272, meaning that the arms 294 and 296 and the roller brush assemblies 290 and 292 are returned to the closed position (FIG. 13), the stop assembly 331 is returned to the stop position (FIGS. 13 and 15) and linear actuator 350 extends, moving the upper transfer holding fingers 334 in the station 272 to the open position (FIG. 13). Station 272 dwells in this condition until another end 282 of a next package 280 breaks the beam of the photo-eye 410, restarting the just described cycle.

When the photo-eye 410 senses an end 282 of a package 280 in the station 272, control apparatus will check the condition of the photo-eye 424 to determine if a package 280 is in the on-deck position 422. If no package is present, the stations 276 and 278 will dwell until at least the next indexing of the conveyor 274. If a package 280 is sensed to be in the on-deck position 422, then, after the next indexing of the conveyor 274, when the package from the on-deck position 422 has entered the station 276, the linear actuator 532 is actuated to move the plunger 526 to the extended position, adhesively securing the end 282 of the package 280 to the exposed adhesive tape 440 positioned under the plunger 526. Simultaneously, the hole puncher 454 is actuated and the punch 459 punches a hole in the strip material 436 and is retracted. The plunger 526 dwells in the extended position for a suitable length of time, such as one fourth of a second, and then the plunger 526 retracts and the bar 546 is moved to the extended position (not shown) causing the upper transfer holding fingers 334 to pivot to the open position (not shown), pretty much simultaneously.

A magnetic proximity switch (not shown) in the linear actuator 532 generates a signal when the plunger 526 reaches the retracted position and that signal is used to activate the station 278. Drive rollers 466 and 468 are activated and they advance the strip material 436, the adhesive tape 440 and the display strip material 503 until an aperture just formed in the strip material 436, by the hole puncher 454, reaches the air switch 460. This condition permits air to flow through the air switch 460, which generates a signal to deactivate the drive rollers 466 and 468. In the meantime, a fresh portion of adhesive tape 440, exposed through an aperture previously formed in the strip material 436, by the hole puncher 454, is positioned under the plunger 526.

A counter (not shown) counts the number of packages 280 that have been installed on display strip material 503. If a display strip with six packages is being produced, as the plunger comes down on the fifth package, the hole puncher 504 is actuated and the punch 508 is extended and retracted, thereby punching a hole, suitable for hanging a completed display strip, in the display strip material 503. When the plunger 526 starts to retract, after a sixth and final package has been adhesively secured to the display strip material 503, the cutter blade 548 is activated meaning that it is advanced and retracted by the linear actuator 552, severing a completed, loaded display strip from the display strip material 503.

Figure 20:
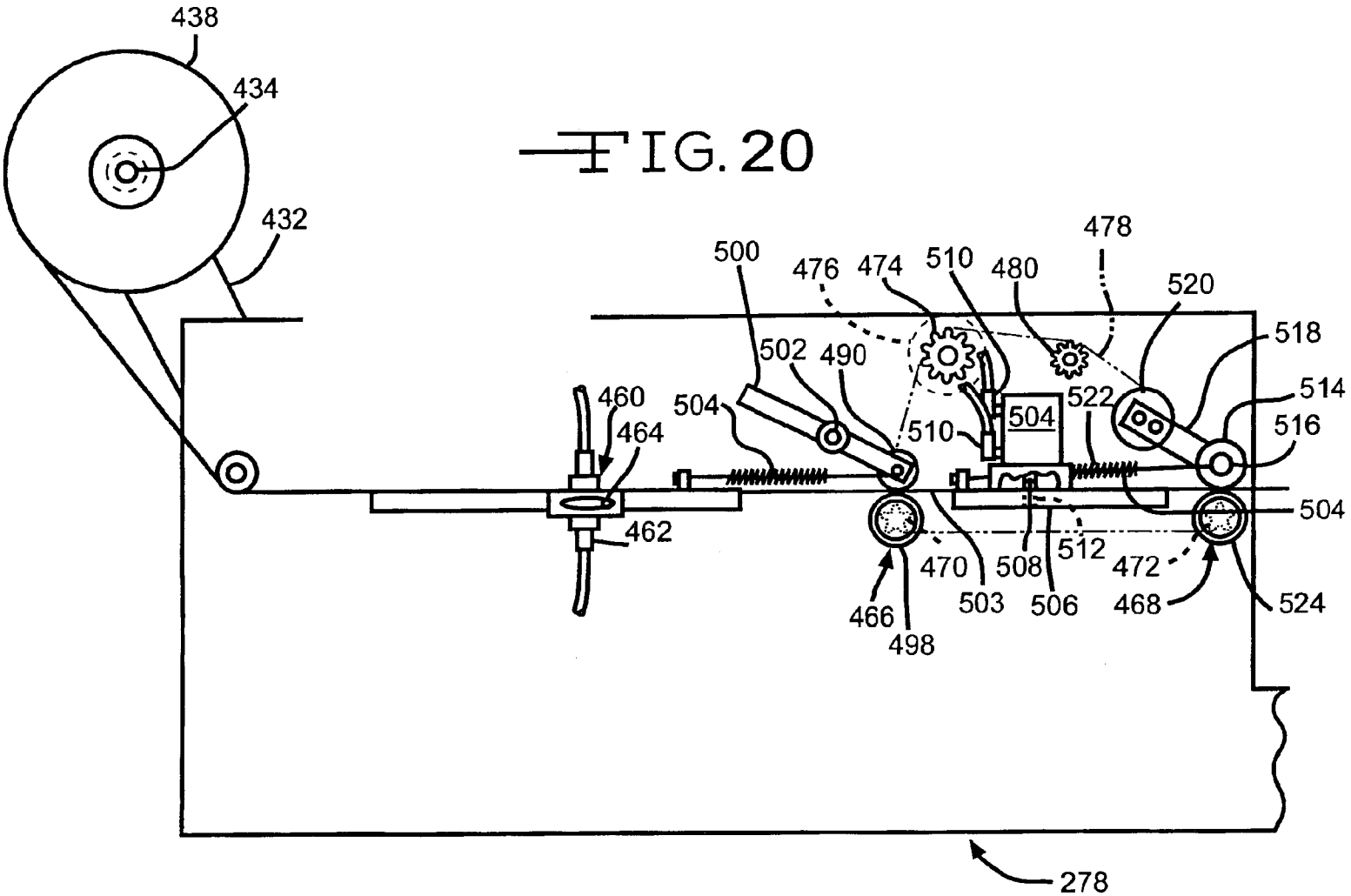
FIG. 20 is a side view of a station that is similar to the station shown in FIG. 17, including modifications for producing a different display strip material.

Referring now to FIG. 20, a station, indicated generally at 570, is operable to produce display strip material, indicated generally at 572 (FIG. 22) and comprising a strip of material 574 with discreet portions 576 of two-sided adhesive tape at spaced intervals along the length of the strip material 574, on one side thereof. The station 570 includes many elements that are described above, with reference to FIG. 17 and these elements are identified by the same reference numerals used in FIG. 17.

Figures 21, 22:
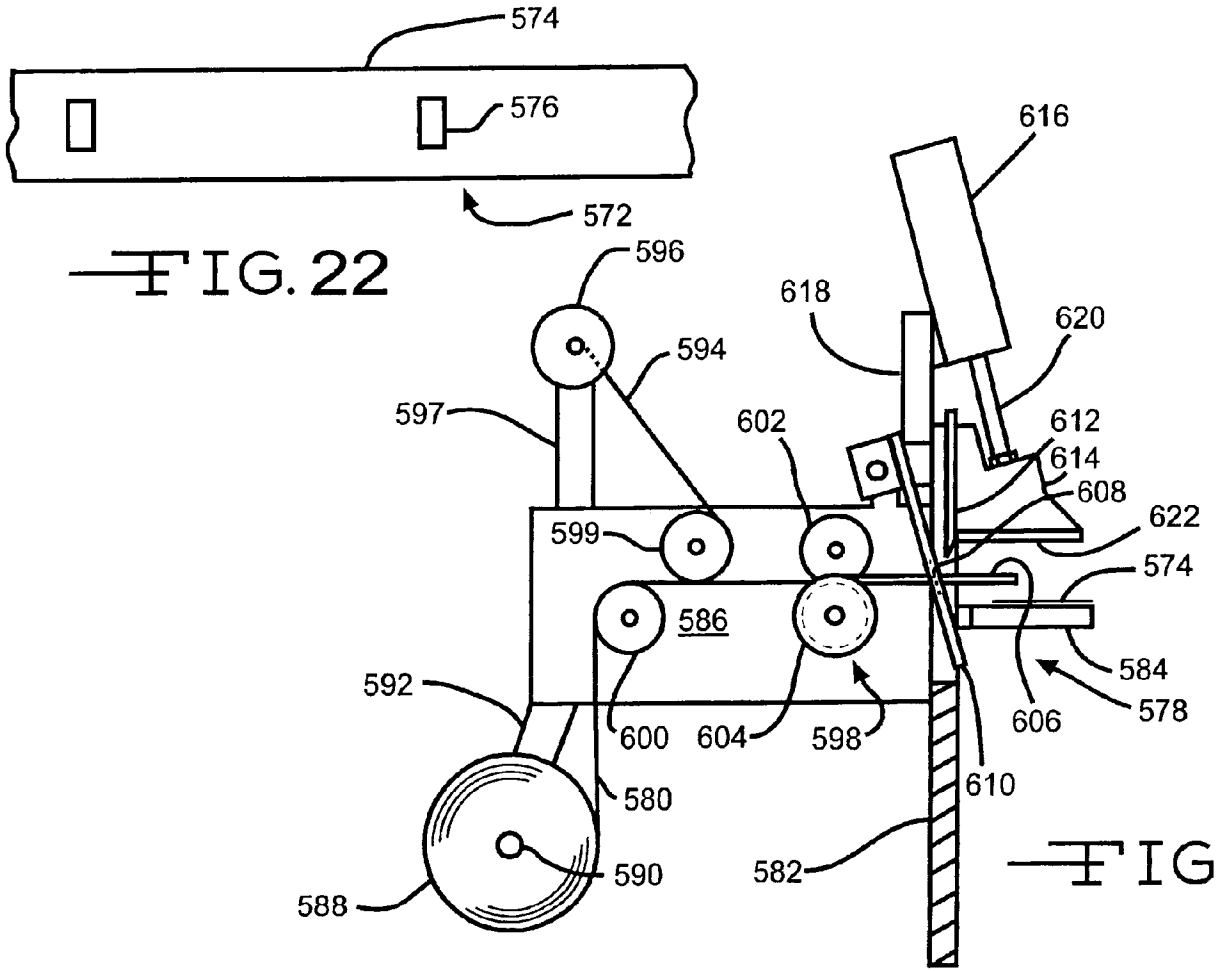
FIG. 21 is a detail view of a portion of the station shown in FIG. 20
FIG. 22 is a top view of display strip material produced by the stations shown in FIGS. 20 and 21.

The station 570 includes apparatus, indicated generally at 578 in FIGS. 20 and 21, that is operable to cut two-sided adhesive tape 580 into discreet portions 576 (FIG. 22) and to apply those portions 576 to strip material 574. The station 578 comprises a side plate 582 and support 432 secured thereto for spindle 434 for supporting a supply of strip material 574 in roll form 438. The drive rollers 466 and 468 are operable to advance the strip material 574, from left to right in FIG. 20, intermittently, along a strip support 584. Actuation of the drive rollers 466 and 468 is controlled so that predetermined portions of the strip material 574 are sequentially positioned adjacent to the apparatus 578, at intervals corresponding with desired spacing between attachment points for packages to be attached to the display strip material 572.

The apparatus 578 comprises a support plate 586 that supports the apparatus 578 on the side plate 582. A roll 588 of two-sided tape 580 is supported on a spindle 590 carried by a support arm 592, which is supported on the support plate 586. The two-sided tape 580 is typically supplied with release paper 594 between layers of the tape 580 in the roll 588. A spool 596 is supported on a support arm 597 that is secured to and supported on the support plate 586. The spool 596 is driven by a slip clutch drive (not shown) so that the spool 596 rotates, and winds up the release paper 594, when the two-sided tape 594 is advanced, from left to right in FIG. 21, by drive means indicated generally at 598, but the clutch drive slips and the spool 596 doesn't rotate when the drive means 598 are not advancing the tape 594. In other words, the slip clutch drive slips before the spool 596 can apply enough tension to unwind two-sided tape 580 from the roll 588, when the drive means 598 are not activated, and doesn't slip when the drive means 598 are activated, so that release paper 594 is wound around a roller 599 and onto the spool 596, only when the drive means 598 are advancing the tape 580.

Two-sided tape 580 is supplied from the roll 588, passes over a roller 600 and passes through the drive means 598, which constitute a tape advancer, and comprise an upper V-drive serrated pulley 602 and a cooperating lower V-drive serrated pulley 604. The pulleys 602 and 604 will be contacting adhesive sides of the tape 580 and should be constituted so that the adhesive does not adhere excessively to the pulleys 602 and 604. The pulleys 602 and 604 should be biased towards each other, by a spring (not shown) for example, so as to enable them to drivingly engage the tape 580. The tape exits the pulleys 602 and 604 so that an end portion of the tape 580, indicated at 606, has a V-shaped configuration. The V-shaped configuration of the tape 580 gives it enough rigidity so that the end portion 606 of tape 580 extends outwardly from the pulleys 602 and 604, as shown in FIG. 21. The end portion 606 extends through a cutter window, indicated at 608 in FIG. 20, which is formed in a cutter plate 610. A cutter blade 612 is mounted for reciprocating movement with a tape install pad 614. A linear actuator 616 is supported on a support bracket 618, which, in turn, is secured to and supported by the side plate 582. The tape install pad 614 is secured to and supported on a plunger 620 of the linear actuator 616 and is movable therewith between a first, retracted position shown in FIGS. 20 and 21, and an extended position (not shown). In the retracted position, the install pad 614, and the cutter blade 612, are positioned above the end portion 606 of the tape 580. As the plunger 620, the install pad 614 and the cutter blade 612 move towards the extended position (not shown), the cutter blade 612, in cooperation with the cutter window 608 and the cutter plate 610, are operable to sever the end piece 606 of the tape 580, and vacuum means (not shown) associated with the install pad 614 are operable to bring the severed end piece 606 of tape 580 to a lower surface 622 of the install pad 614 and hold it there temporarily.

In the extended position (not shown), the install pad 614 presses against the strip material 574 and the severed end piece 606 of tape 580 is pressed against the strip material 574, in a predetermined location. It will be appreciated that the lower surface 622 of the install pad 614 should be treated to prevent the two-sided tape 580 from sticking to it. Suitable treatment would include, but is not limited to, a plasma coating such as the 936 plasma coating referred to above. The non-stick treatment will facilitate the release of the tape 580 when it is pressed by the install pad 614 against the strip material 574.

The station 570 and the apparatus 578 are operated together to produce display strip material 572. The drive rollers 466 and 468 are activated and they advance the strip material 574 a given distance corresponding with a desired spacing, center to center, between portions 576 of two-sided adhesive tape 580 on display strip material 572. The drive rollers 466 and 468 are then stopped and, while the strip material 574 dwells, the plunger 620 (FIG. 21) is extended from the retracted position shown in FIGS. 20 and 21, whereby the cutter blade 612 severs an end portion 606 of two-sided tape, which portion is brought to the lower surface 622 of the install pad 614, by vacuum means (not shown) or other suitable means, and held there, temporarily. The plunger 620 continues to move to the extended position until the install pad 614 presses a portion 576 of two-sided adhesive tape 580 onto the strip material 574 positioned under the install pad 614. The plunger 620 is withdrawn and the drive rollers 466 and 468 are activated to advance the strip material 574 and the display strip material 572 the given distance. While the display strip material 572 and the strip material 574 are advanced in station 570, the drive wheels 602 and 604 of apparatus 578 are activated to advance a predetermined length of two-sided tape 580 through the cutter window 608 in the cutter plate 610. The predetermined length of tape 580 corresponds with the length of the portion 576 of two-sided tape 580. When the strip material 574 has been advanced the given distance to position a next portion of strip material 574 under the install pad 614, the foregoing steps are repeated until a desired number of portions 576 of two-sided tape 580 have been affixed to the strip material 574. At that point, a cutter blade such as cutter blade 548 (FIGS. 18 and 19) severs a display strip from the display strip material 572. Merchandise can then be secured to the portions 576 of two-sided tape 580, manually or automatically.

The station 570 and the apparatus 578 are well-suited to work in conjunction with a station, such as station 276 (FIGS. 18 and 19), for securing packages 280 to the segments 576 of two-sided adhesive tape 580 on the display strip material 572 and for severing a pre-loaded merchandising strip form the display strip material 572. Preferably, this is done sequentially as the display strip material 572 is advanced, left to right, in FIG. 20. The packages 280 may be conveyed, as described above, to a station, such as station 276, for attachment thereof to adhesive tape portions 576, as display strip material 572 is conveyed to that station. Alternatively, packages 280 can be manually transported into a station and either be held there, between a plunger and an anvil, for example, while a portion of the package is pressed against an adhesive tape portion 576, or be manually pressed against an adhesive tape portion 576. When the desired number of packages has been secured to the display strip material 572, a pre-loaded display strip (not shown) can be severed from the display strip material 572.

It is preferred that the two-sided tape 580 has different adhesive properties on each side. That is, a first side of the adhesive tape 580, which side will be adhered to the strip material 574, preferably has a first, given degree of adhesiveness, while the second side of the adhesive tape 580, which side will be adhered to a portion of a product or packaging for the product, will have a second degree of adhesiveness that is less than the first, given degree of adhesiveness. This can be effected by controlling the amount of adhesive on each side of the adhesive tape 580 or controlling the types of adhesives or in other ways that are known in the trade. People known as facilitators produce two-sided adhesive tape with different adhesive properties on each side. This preferred two-sided tape helps ensure that the tape 580 will remain on the strip material 574 when a package 280 adhered to a tape portion 576 of the tape 580 is removed therefrom.

Figures 23, 24:
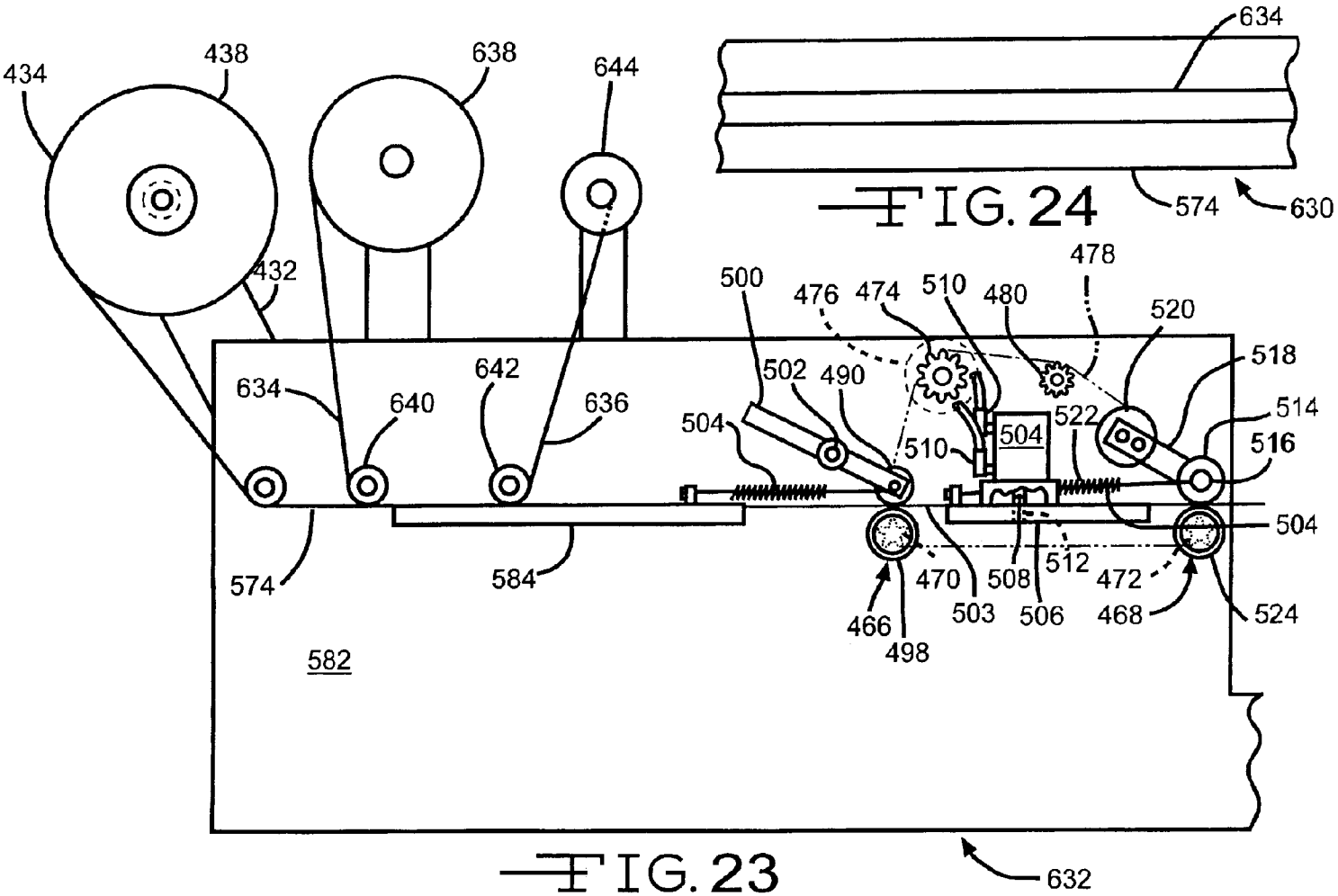
FIG. 23 is a side view of a station that is similar to the station shown in FIG. 20, including modifications for producing a different display strip material.
FIG. 24 is a top view of display strip material produced by the station shown in FIG. 23.

Apparatus for producing a display strip material 630 illustrated in FIG. 24 is indicated generally at 632 in FIG. 23. The display strip material 630 comprises strip material 574 and two-sided adhesive tape 634 that is preferably located in a central region of the strip material 574, as shown in FIG. 24. The apparatus 632 corresponds, in many regards, to apparatus 570 shown in FIG. 20 and like reference numerals have been used to identify like components. Strip material 574 is supplied from a roll 438 and is advanced, intermittently, by drive wheels 466 and 468, from left to right in FIG. 23. Two-sided adhesive tape 634, with a release paper 636, is supplied from a roll 638 and is adhered to the strip material 574 as they pass under a pressure roller 640. The release paper 636 passes over a roller 642 and is wound onto a take up spool 644 that is driven by a slip clutch drive (not shown) so that the spool 644 winds up release paper 636 only whenever the drive wheels 466 and 468 are advancing the strip material 574 and the two-sided tape 634.

The apparatus 632 is operable to position pre-selected portions of the two-sided tape 634 in a single location, for example, the anvil 528 in station 276 (FIGS. 18 and 19), for the adhesive attachment thereto of portions of packages 280. Again, the apparatus 632 is well suited to work in conjunction with a station, such as station 276 (FIGS. 18 and 19), for securing packages 280 to pre-selected portions of two-sided adhesive tape 634 on the display strip material 630 and for severing a pre-loaded display strip (not shown) from the display strip material 630. Preferably, this is done sequentially as the display strip material 630 is advanced, left to right, in FIG. 23. The packages 280 may be conveyed, as described above, to a station, such as station 276, for attachment thereof to portions of adhesive tape 634, as display strip material 630 is conveyed to that station. Alternatively, packages 280 can be manually transported into a station and either be held there, between a plunger and an anvil, for example, while a portion of the package is pressed against a portion of adhesive tape 634, or be manually pressed against a portion of adhesive tape 634. When the desired number of packages has been adhered to the adhesive tape, in spaced relationships, a pre-loaded display strip (not shown) can be severed from the display strip material 630, as described above.

Figure 25:
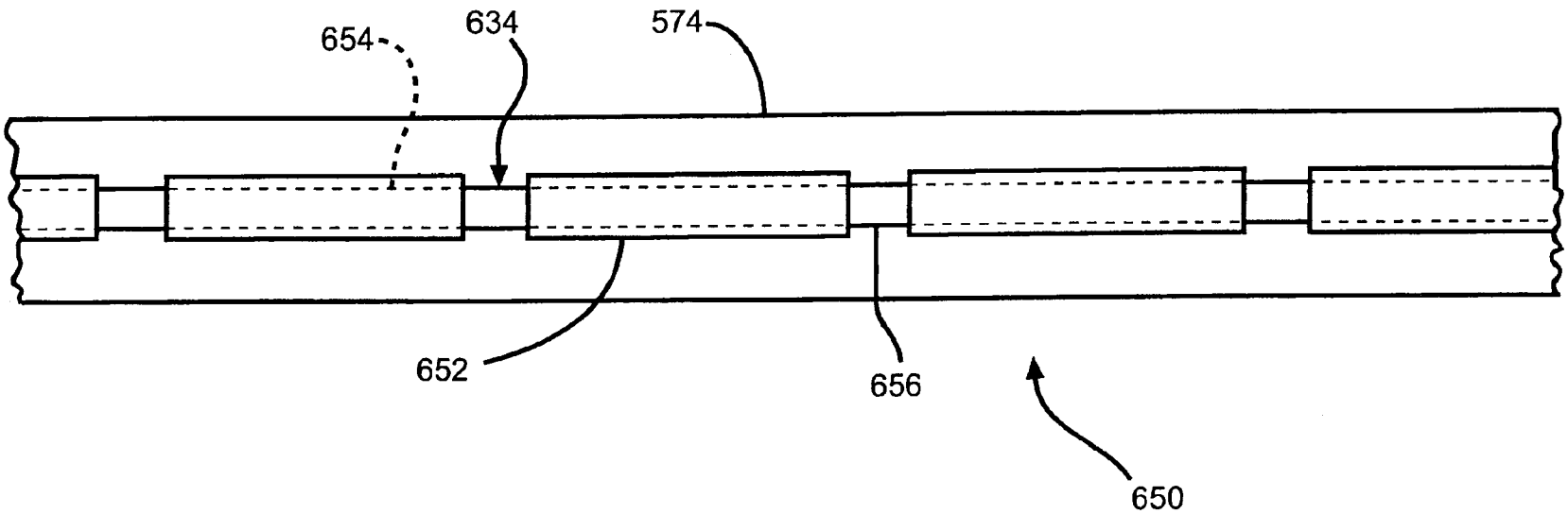
FIG. 25 is a top view of display strip material that can be produced by a station including apparatus from the stations shown in FIGS. 20 and 23.

A further embodiment of display strip material according to the present invention is indicated generally at 650 in FIG. 25. The display strip material 650 comprises strip material 574 with two-sided adhesive tape 634 positioned centrally on the strip material 574. Discreet portions of non-sticky material 652 cover selected portions 654 of the two-sided tape 634, leaving selected portions 656 of two-sided tape 634 exposed for securing portions of products or packaging for products thereto. As described above, apparatus 632 can be operated to produce display strip material 630 comprising strip material 574 and two-sided adhesive tape 634 secured thereto, extending longitudinally with the strip material 574 and centrally located thereon. The apparatus 578 can be modified by substituting a roll of non-sticky material, such as paper, foil, polymeric film or the like, for the two-sided tape roll 588, and eliminating the release paper take-up spool 596, so that the apparatus 578 is operable to cut portions of non-sticky material 652 and to position and press them onto pre-selected portions of the two sided tape 634 in FIG. 25, as shown. Again, the display strip material 650 is preferably associated with a station, such as station 276 (FIGS. 18 and 19), so that, sequentially, exposed portions 656 of two-sided tape 634 are positioned in a single location at which portions of products or packaged products are adhesively secured to them, and, preferably, a pre-loaded merchandiser is severed from the display strip material 650, as described above.

I claim:

1. A merchandiser for holding a number of items, comprising:

a strip of material;

a plurality of discrete portions of two-sided adhesive tape adhered to the strip and corresponding in number to at least the number of items to be held by the merchandiser, said portions being capable of releasably adhering to the strip items to be held by the merchandiser;

and wherein the adhesiveness between the adhesive portions and the items to be adhered to the strip is less than the adhesiveness between the adhesive portions and the strip, so that the adhesive portions remain on the strip when an item is removed therefrom.

2. The merchandiser of claim 1, wherein the degree of adhesiveness is greater on one side of the tape than on an other side of the tape.

3. The merchandiser of claim 1, wherein the amount of adhesive is more on one side of the tape than an other side of the tape.

4. The merchandiser of claim 1, wherein the adhesive on one side of the tape is different from the adhesive on an other side of the tape.

* * * * *